US012209784B2

(12) United States Patent
Song et al.

(10) Patent No.: US 12,209,784 B2
(45) Date of Patent: Jan. 28, 2025

(54) REFRIGERATING APPARATUS USING NON-AZEOTROPIC MIXED REFRIGERANT

(71) Applicant: LG ELECTRONICS INC., Seoul (KR)

(72) Inventors: Minho Song, Seoul (KR); Changho Seo, Seoul (KR); Kyeongyun Kim, Seoul (KR); Yongjoo Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 326 days.

(21) Appl. No.: 17/634,185

(22) PCT Filed: Aug. 20, 2020

(86) PCT No.: PCT/KR2020/011139
§ 371 (c)(1),
(2) Date: Feb. 9, 2022

(87) PCT Pub. No.: WO2021/034133
PCT Pub. Date: Feb. 25, 2021

(65) Prior Publication Data

US 2022/0357079 A1 Nov. 10, 2022

(30) Foreign Application Priority Data

Aug. 21, 2019 (KR) ..... 10-2019-0102345

(51) Int. Cl.
*F25B 6/02* (2006.01)
*F25B 41/20* (2021.01)

(52) U.S. Cl.
CPC ..... *F25B 6/02* (2013.01); *F25B 41/20* (2021.01); *F25B 2400/0409* (2013.01)

(58) Field of Classification Search
CPC .... F25B 6/02; F25B 41/20; F25B 2400/0409; F25B 47/02; F25B 47/022; F25D 23/061;
(Continued)

(56) References Cited

U.S. PATENT DOCUMENTS 10,907,872 B2 * 2/2021 Choi ..... F25D 21/008
2006/0243944 A1 * 11/2006 Minor ..... C08J 9/149 252/67

(Continued)

FOREIGN PATENT DOCUMENTS

CN 202267282 U 6/2012
CN 102322703 B 7/2013

(Continued)

OTHER PUBLICATIONS

English translation of Yoshida et al. (JPS 58-140583) (Year: 1983).*

*Primary Examiner* — Miguel A Diaz
(74) *Attorney, Agent, or Firm* — Bryan Cave Leighton Paisner LLP

(57) ABSTRACT

A refrigerating apparatus may include a main body having an interior space in which an article is accommodated, a door configured to open and close an opening of the main body, a compressor configured to compress a non-azeotropic mixed refrigerant, a condenser configured to condense the compressed non-azeotropic mixed refrigerant, a hotline provided at a contact portion between the main body and the door through which the condensed non-azeotropic mixed refrigerant flows, an expander configured to expand the non-azeotropic mixed refrigerant, heat of which is radiated by the hotline, and an evaporator configured to evaporate the expanded non-azeotropic mixed refrigerant to supply cold air to the interior space. According to such structure, even when the non-azeotropic mixed refrigerant is used, a function of the hotline to prevent dew formation may be normally performed with hot refrigerant.

20 Claims, 11 Drawing Sheets

(58) Field of Classification Search
CPC ..... F25D 21/00; F25D 21/04; F25D 21/12; F25D 21/06; F25D 2321/1412; F25D 2321/1411
See application file for complete search history.

(56) References Cited

U.S. PATENT DOCUMENTS

| | | | | |
|---|---|---|---|---|
| 2009/0261289 | A1* | 10/2009 | Ham | C09K 5/042 252/67 |
| 2010/0082160 | A1 | 4/2010 | Kondou et al. | |
| 2013/0111943 | A1 | 5/2013 | Yoon et al. | |
| 2018/0120018 | A1* | 5/2018 | Mrzyglod | F25D 21/12 |

FOREIGN PATENT DOCUMENTS

| | | | |
|---|---|---|---|
| CN | 204987625 | U | 1/2016 |
| JP | S58140583 | A | 8/1983 |
| JP | S5949453 | A | 3/1984 |
| JP | 2523783 | B2 | 8/1996 |
| KR | 10-2004-0055675 | A | 6/2004 |
| KR | 10-2006-0108832 | A | 10/2006 |
| KR | 10-2013-0050700 | A | 5/2013 |

* cited by examiner

[Fig. 1]
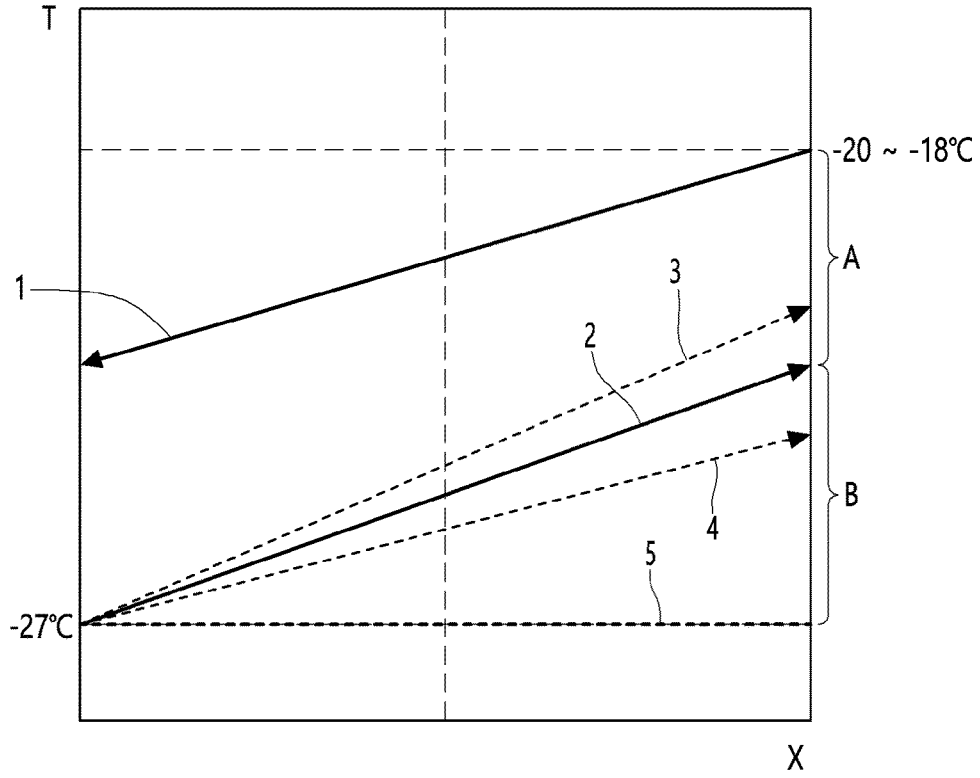
[Fig. 2]
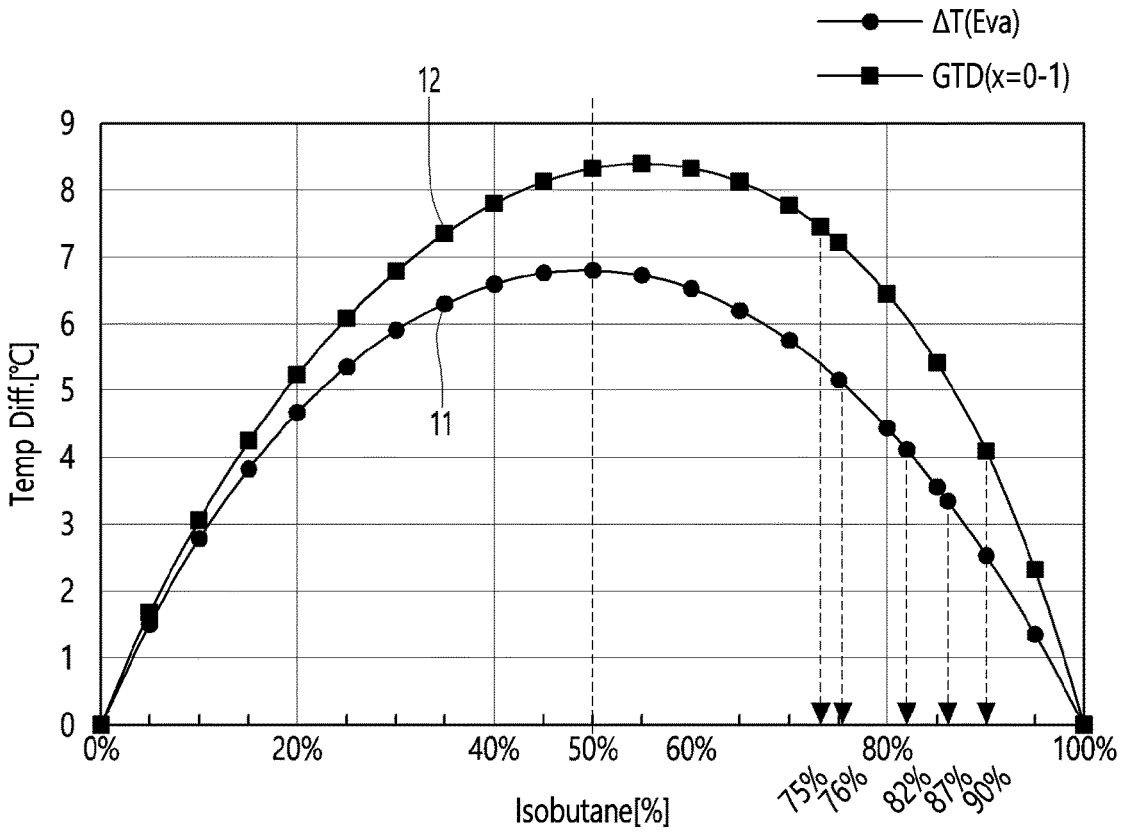

[Fig. 3A]
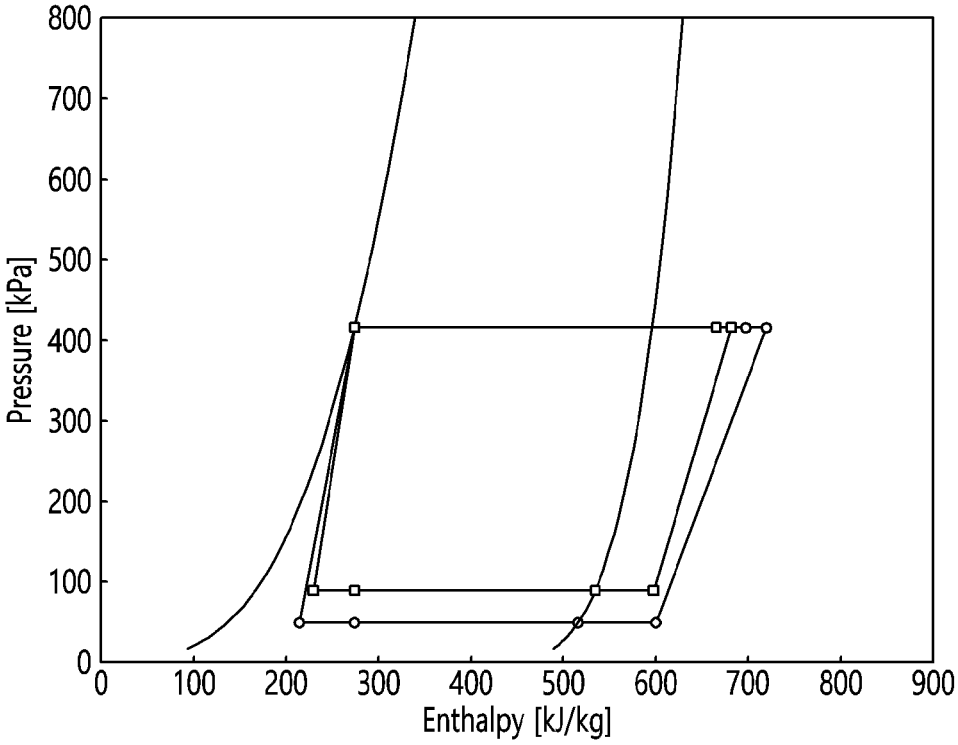
[Fig. 3B]
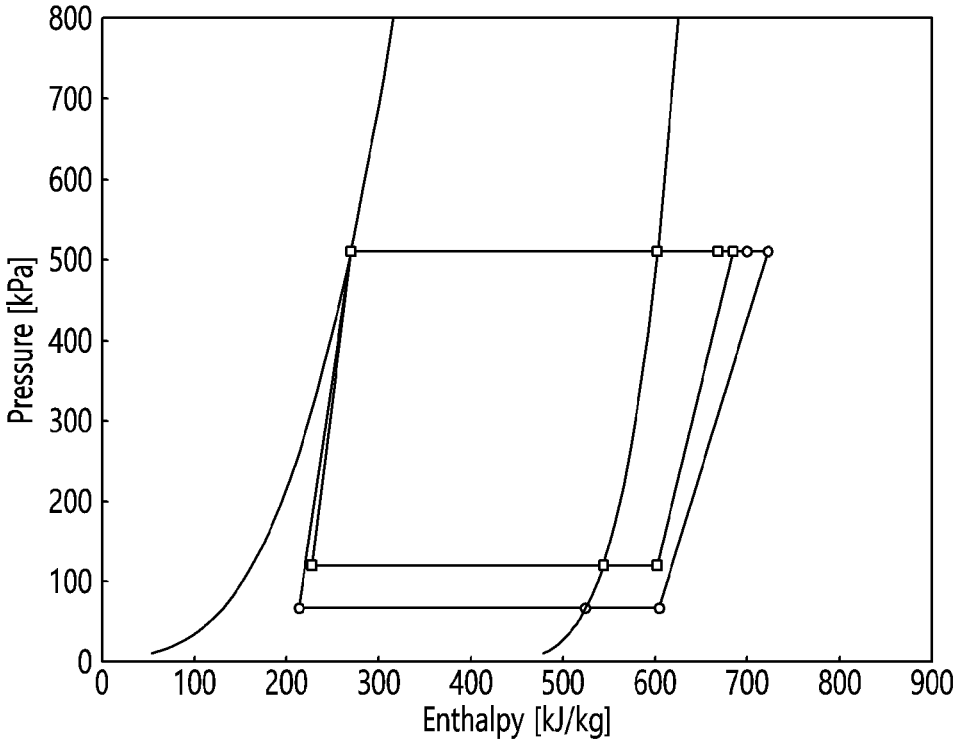

[Fig. 4]
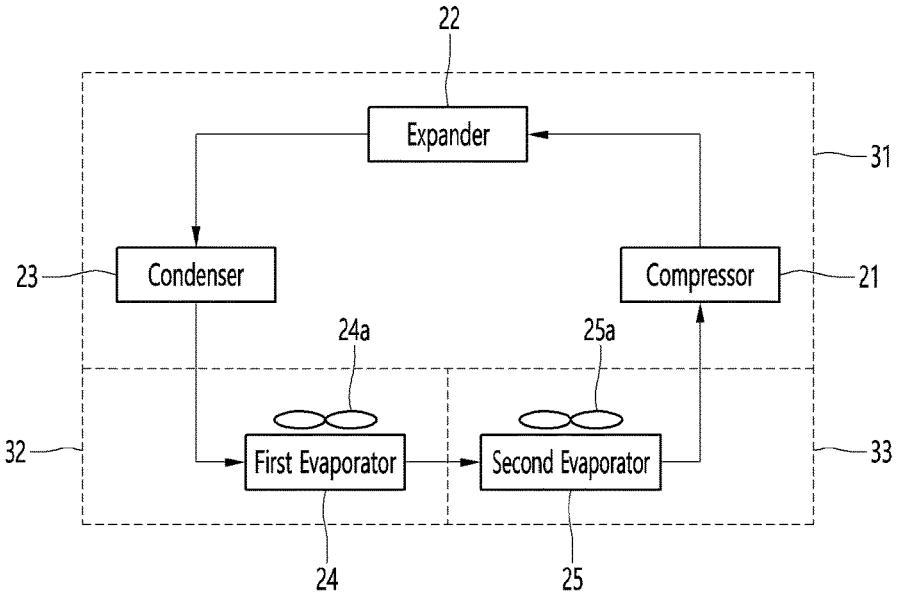
[Fig. 5]
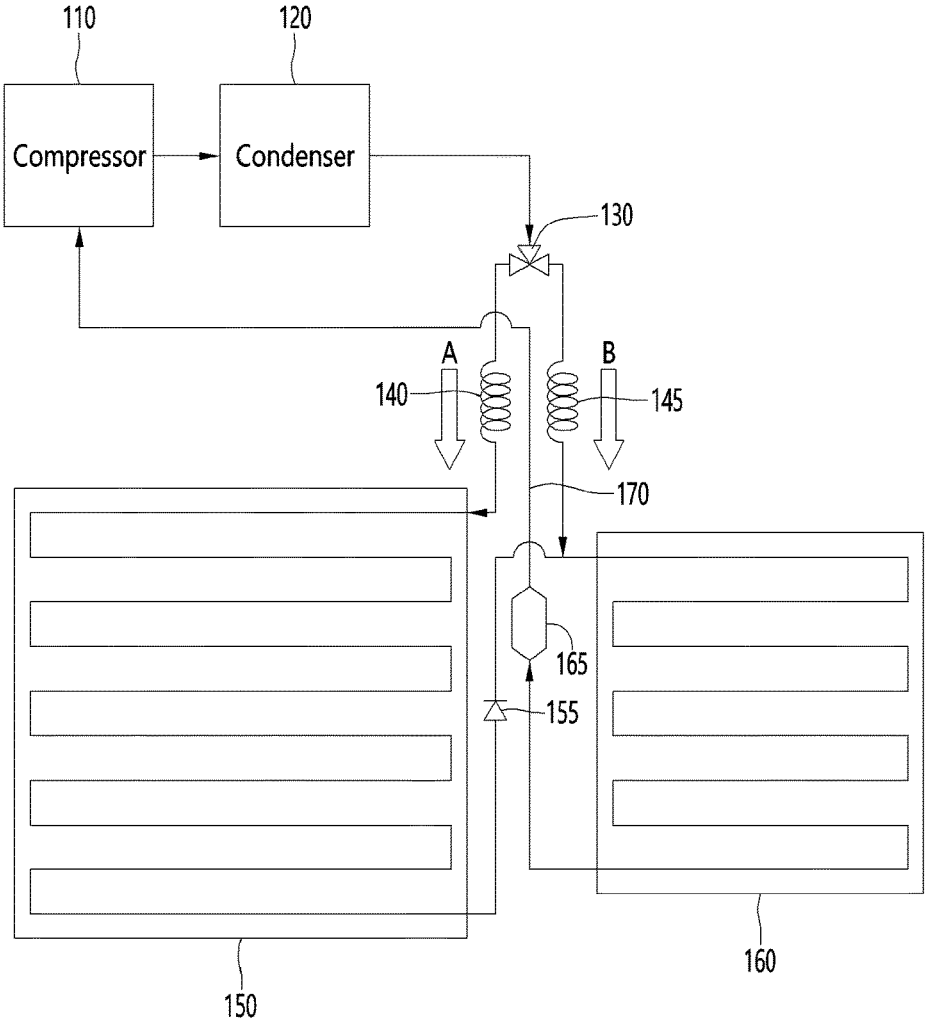

[Fig. 6]
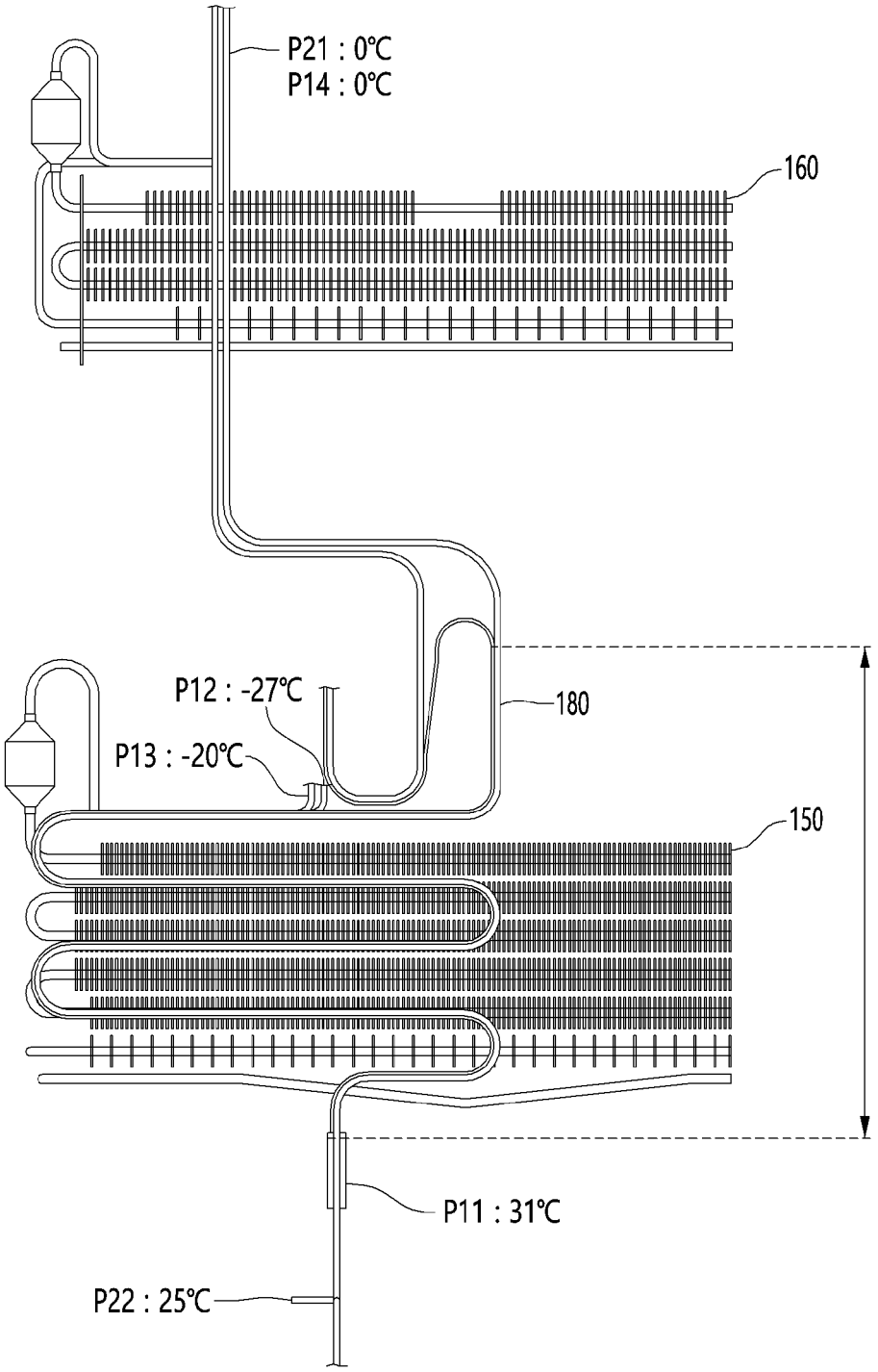

[Fig. 7]
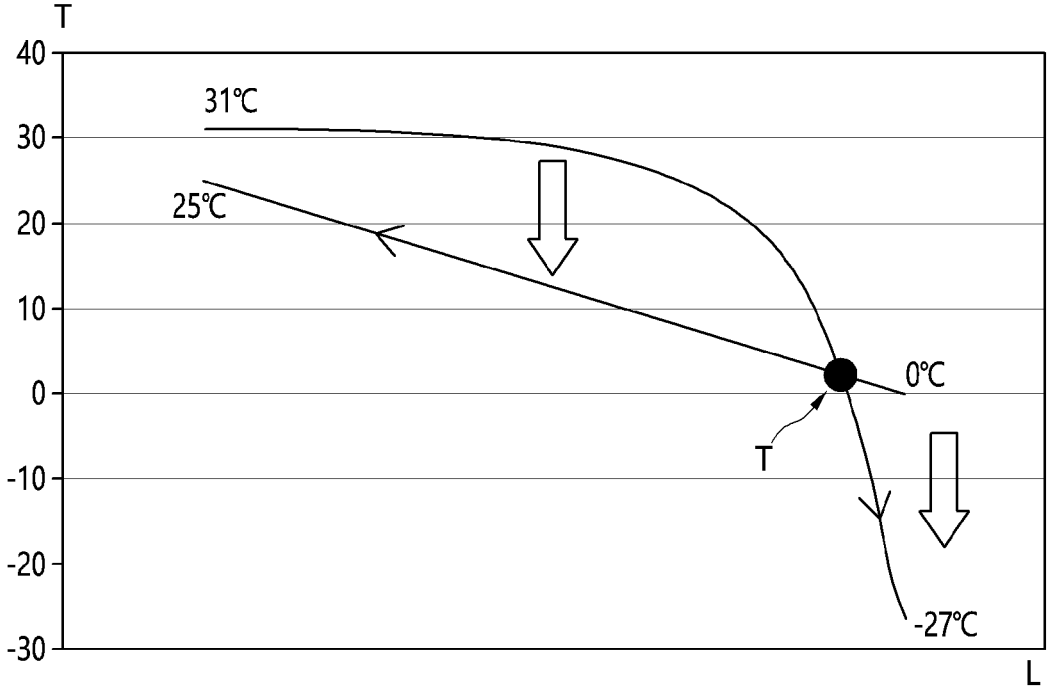

[Fig. 8]
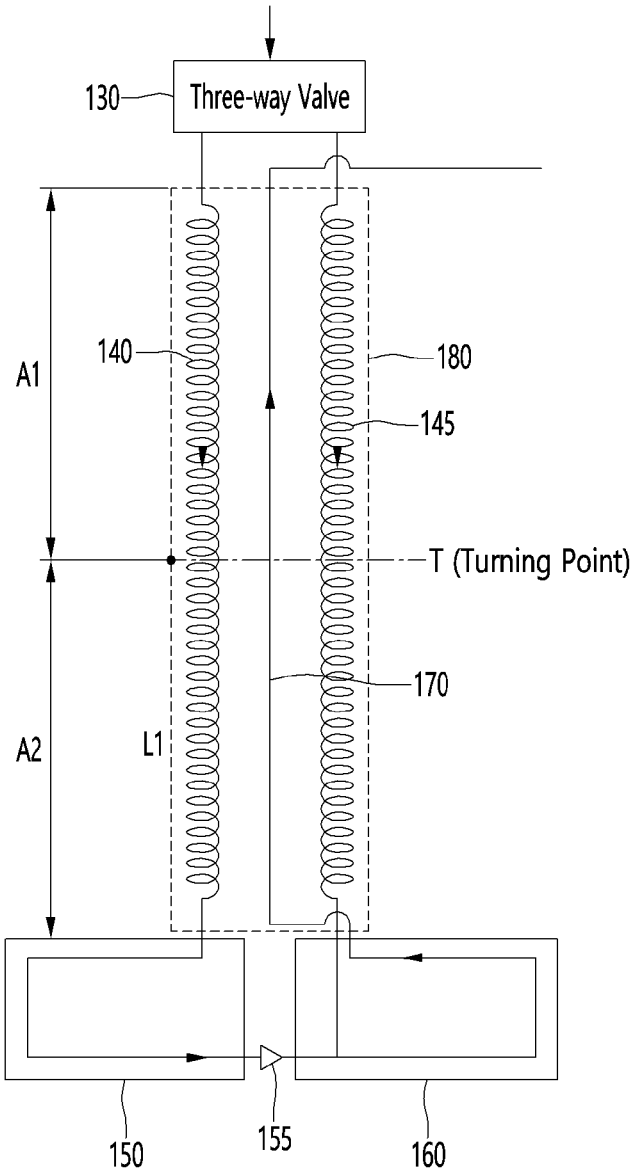

[Fig. 9]
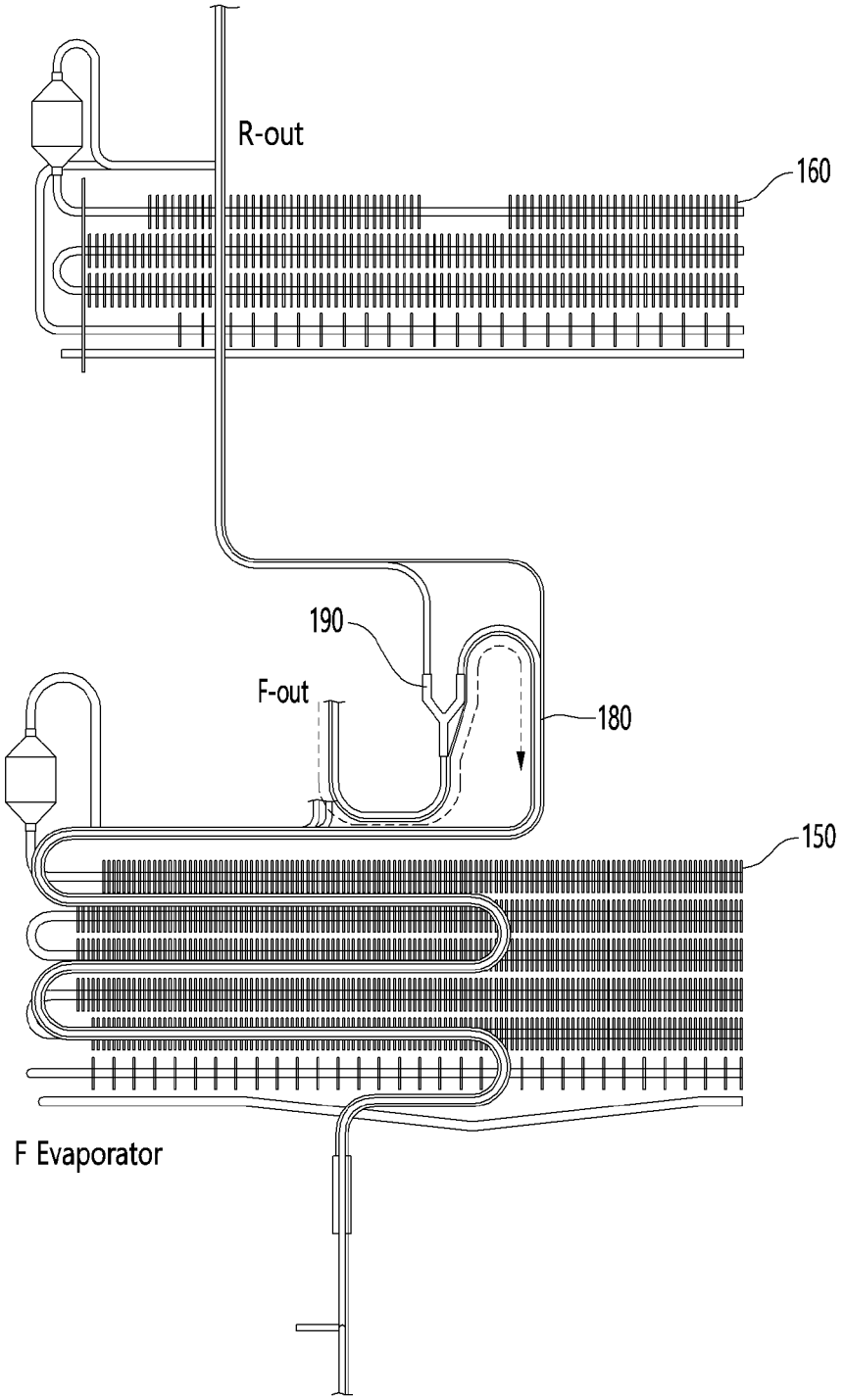

[Fig. 10A]
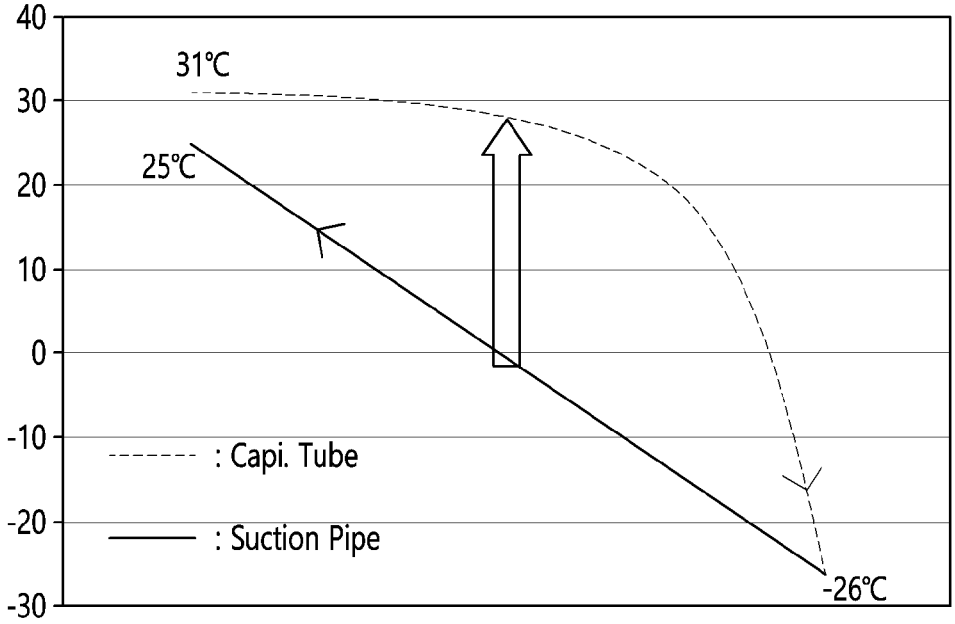
[Fig. 10B]
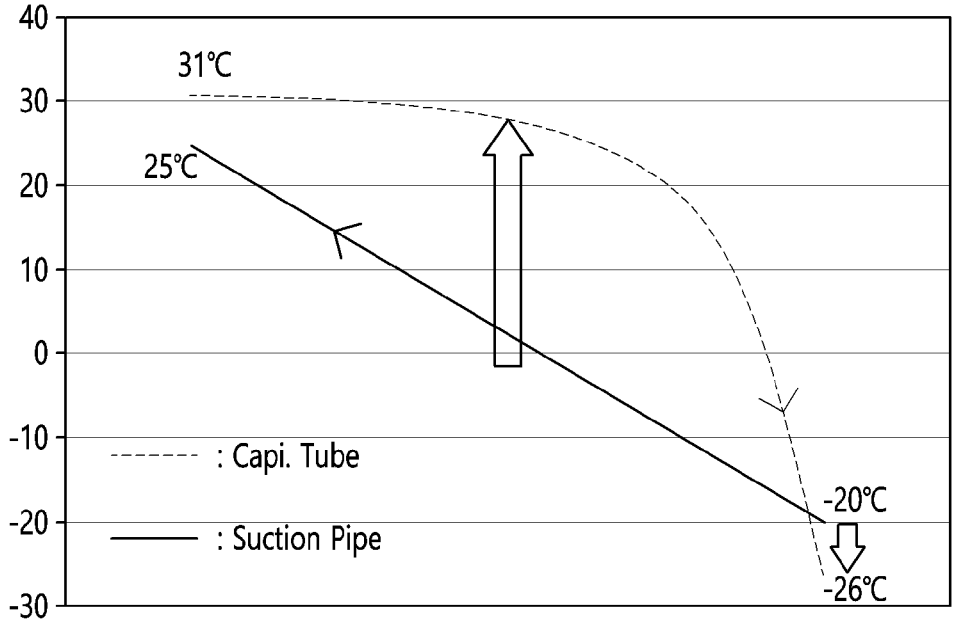

[Fig. 11]
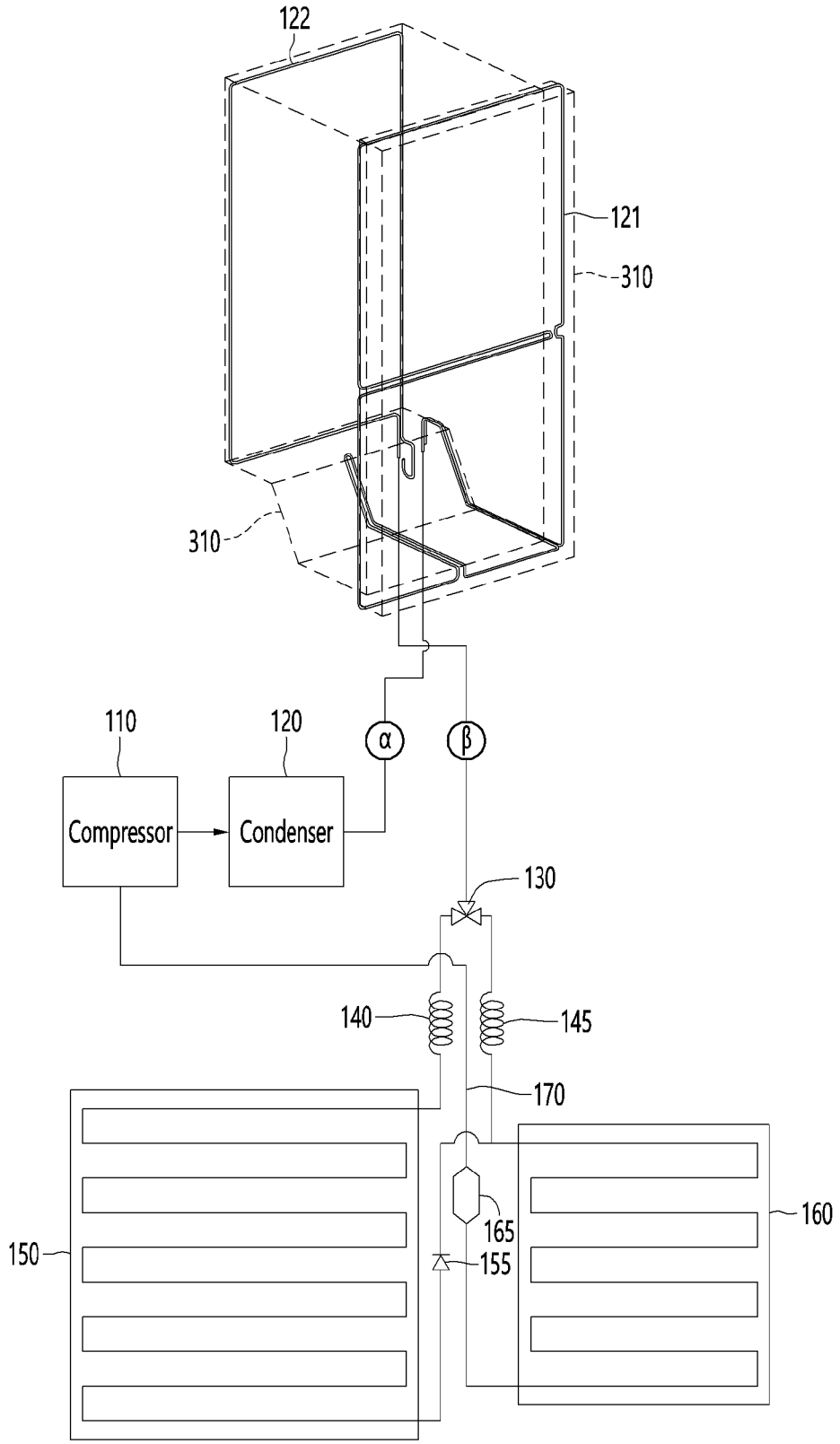

[Fig. 12]
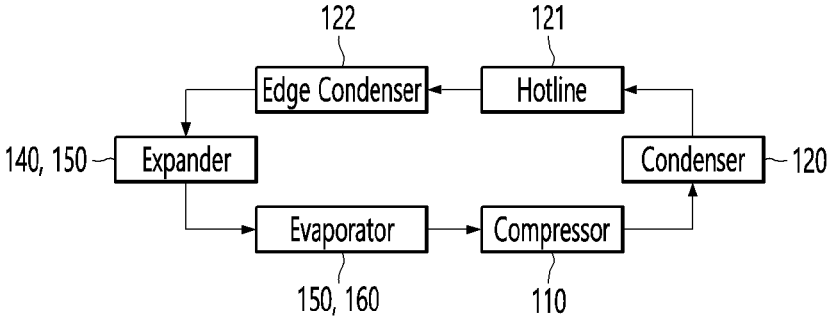
[Fig. 13]
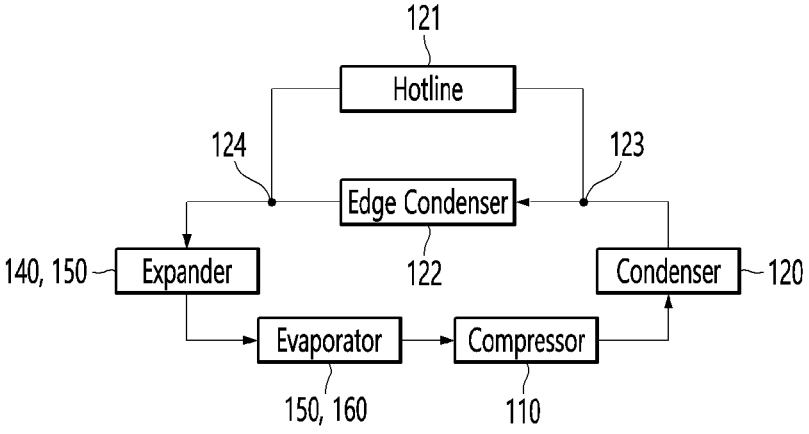

[Fig. 14]
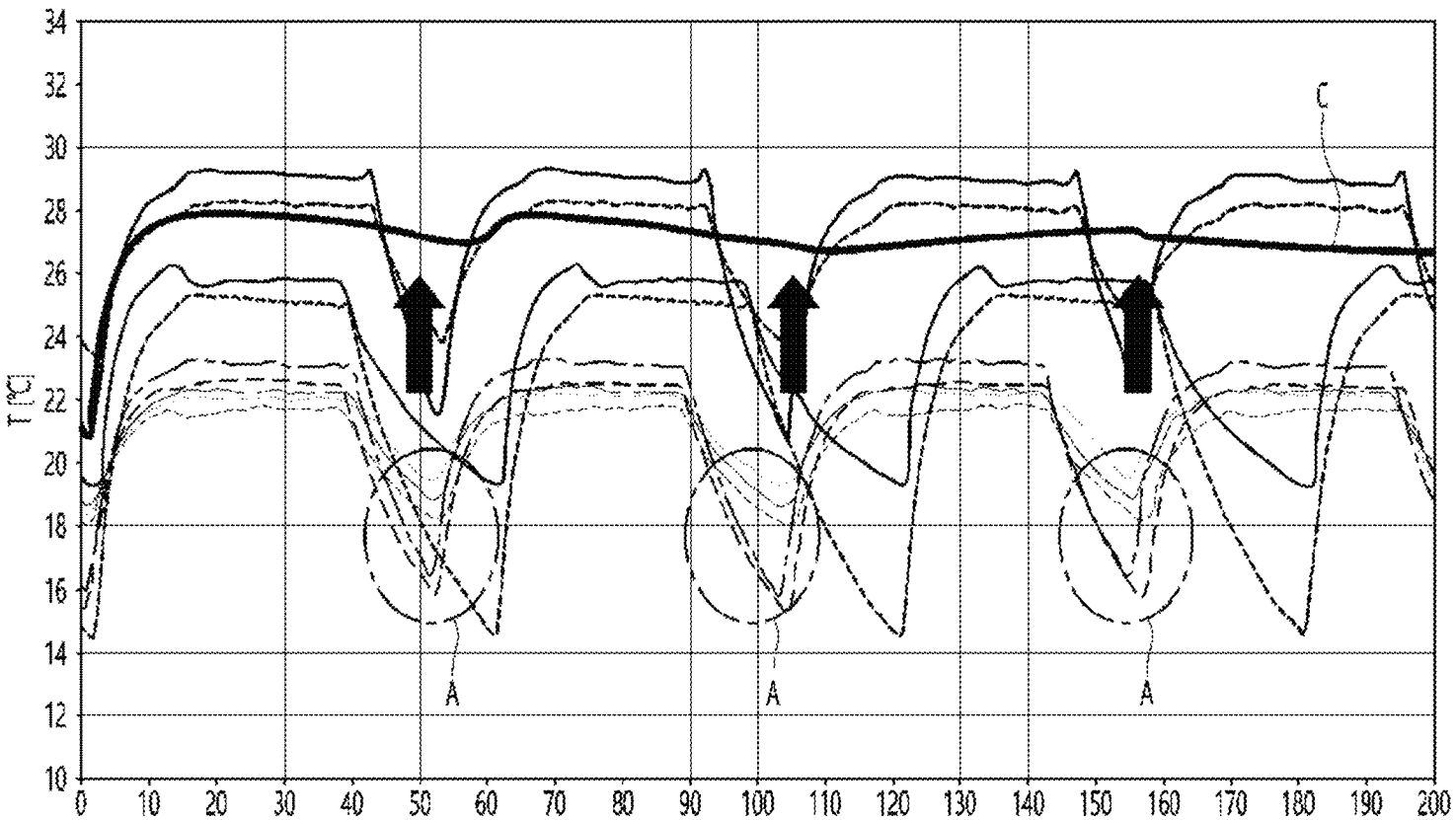

REFRIGERATING APPARATUS USING NON-AZEOTROPIC MIXED REFRIGERANT

This application is the National Stage filing under 35 U.S.C. 371 of International Application No. PCT/KR2020/011139, filed on Aug. 20, 2020, and claims priority to and the benefit of Korean Application No. 10-2019-0102345, filed on Aug. 21, 2019, all of which are incorporated by reference in their entirety herein.

TECHNICAL FIELD

A refrigerating apparatus using a non-azeotropic mixed refrigerant is disclosed herein.

BACKGROUND ART

A refrigerating apparatus is an apparatus that stores articles by providing cold air. In the refrigeration apparatus, a refrigerant circulates through processes of compression, condensation, expansion, and evaporation.

There are various types of refrigerants. A mixed refrigerant is a refrigerant in which two or more types of refrigerants are mixed. Mixed refrigerants include azeotropic mixed refrigerant and non-azeotropic mixed refrigerant.

The azeotropic mixed refrigerant is a refrigerant that changes phase without changing a composition of a gas phase and a liquid phase, similar to a single refrigerant. An evaporation temperature of the azeotropic mixed refrigerant is constant between an inlet and an outlet of the evaporator.

In the non-azeotropic mixed refrigerant, a refrigerant having a low boiling point evaporates first, and a refrigerant having a high boiling point evaporates later. Therefore, the non-azeotropic mixed refrigerant has different gas phase and liquid phase compositions during evaporation, and the evaporation temperature is low at the inlet of the evaporator and high at the outlet of the evaporator.

The non-azeotropic mixed refrigerant has a gliding temperature difference (GTD), which is a characteristic in which the temperature changes at equal pressure during phase change. Therefore, an evaporation operation of the non-azeotropic mixed refrigerant is divided into two evaporators. The first evaporator may be used for a freezer compartment, and the second evaporator through which the refrigerant having passed through the first evaporator may be used for a refrigerating compartment. The freezer compartment maintains a lower temperature than the refrigerating compartment. A multi-stage evaporator may be provided to increase a performance coefficient of the refrigerating system.

Documents that discloses such a refrigerating system are Korean Patent No. 2011-0115911 (hereinafter "Prior Art Document 1") entitled "Refrigerating apparatus using non-azeotropic mixed refrigerant and control method thereof" and U.S. Patent Publication No. 2015/0096325 (hereinafter "Prior Art Document 2") entitled "Refrigerators with a non-azeotropic mixtures of hydrocarbons refrigerants", which are both hereby incorporated by reference. Prior Art Document 1 discloses a refrigerating apparatus including one compressor, two evaporators connected in series to the compressor, and a three-way valve located between the two evaporators to bypass a refrigerant introduced into a downstream refrigerating compartment evaporator.

According to Prior Art Document 1, the refrigerant that has passed through cold air having passed through an upstream freezer compartment evaporator is introduced into the three-way valve. At this time, as the refrigerant discharged from the freezer compartment evaporator is at an extremely low temperature reaching −20° C., there are problems, such as loss of cold air through the three-way valve located at an outside and the occurrence of frost on the outer surface of the three-way valve. In addition, an operation of cooling the refrigerating compartment alone may be impossible in terms of the position of the three-way valve.

Prior Art Document 2 discloses a refrigerating apparatus including one compressor, two evaporators connected in series to the compressor, and two heat exchangers in which refrigerant discharged from the two evaporators exchange heat with capillary tubes that expand the refrigerant. According to Prior Art Document 2, the operation of the freezer compartment or the refrigerating compartment alone is impossible. That is, only simultaneous operation of cooling the freezer compartment and the refrigerating compartment is possible. In addition, the refrigerating compartment evaporator into which the refrigerant discharged from the freezer compartment evaporator is introduced may be overcooled.

In the non-azeotropic mixed refrigerant, a temperature of refrigerant discharged from a condenser is low, in comparison to a refrigerating apparatus using a single refrigerant providing a same refrigeration capacity. Therefore, an amount of heat radiated in a hotline provided at a contact portion between a main body and a door to prevent dew formation is insufficient, and dew formation may occur.

DISCLOSURE

Technical Problem

Embodiments disclosed herein optimize a hotline arrangement of a refrigerating apparatus using a non-azeotropic mixed refrigerant. Further, embodiments disclosed herein provide a refrigerating apparatus capable of constructing a hotline according to flow characteristics of a non-azeotropic mixed refrigerant and preventing dew formation on or at a contact portion between a door and a main body.

Technical Solution

According to embodiments disclosed herein, a refrigerating apparatus may include a main body in which an article may be accommodated, a door configured to open and close an opening of the main body, a compressor configured to compress a non-azeotropic mixed refrigerant, a condenser configured to condense the compressed non-azeotropic mixed refrigerant, a hotline provided at a contact portion between the main body and the door through which the non-azeotropic mixed refrigerant passing through the condenser flows, an expander configured to expand the non-azeotropic mixed refrigerant, heat of which may be radiated by the hotline, and an evaporator configured to evaporate the expanded non-azeotropic mixed refrigerant to supply cold air. According to embodiments disclosed herein, it is possible to prevent malfunction of the hot line due to a gliding temperature difference during evaporation of the non-azeotropic mixed refrigerant and to prevent dew formation on or at an interface between the main body and the door.

The refrigerating apparatus may further include an edge condenser provided between the hotline and the expander to further radiate heat of the non-azeotropic mixed refrigerant. The condenser and the hotline may compensate for an insufficient amount of condensation.

The hotline may be placed on a front insulating wall of the main body, and an edge condenser may be placed on a rear insulating wall of the main body. Therefore, it is possible to prevent the problem from occurring in operation of the refrigerating apparatus. The refrigerating apparatus may further include an edge condenser provided in parallel with the hotline between the hotline and the expander. A control width for a condensation amount of the non-azeotropic mixed refrigerant may be increased.

The hotline may be placed on the front insulation wall of the body, and the edge condenser may be placed on the rear insulation wall of the body, such that heat interference may be prevented from occurring therebetween. In other words, a heat radiation efficiency may be increased.

The refrigerating apparatus may further includes a valve between a branch portion or branch and a joint portion or joint that distribute the non-azeotropic mixed refrigerant into the hotline and the edge condenser and join the non-azeotropic mixed refrigerant. Therefore, it is possible to control an amount of the non-azeotropic mixed refrigerant flowing into the hotline. In this case, as the refrigerant flowing through the hotline may be stably secured, dew formation may be prevented.

An inlet of the hotline and an outlet of the condenser may be directly connected without other parts or components therebetween. Therefore, flow of condensation heat through the hot line may be stably performed. In order to continuously supply the non-azeotropic mixed refrigerant to the hotline, the compressor may perform a continuous operation mode in which weak cooling power may be continuously supplied by controlling one of a frequency and stroke of the compressor.

The evaporator may include a first evaporator configured to provide cold air to a freezer space, and a second evaporator configured to provide cold air to a refrigerating space. Therefore, it is possible to provide cold air suitable for each interior space.

The compressor may operate in the continuous operation mode, such that refrigerant is continuously supplied to the hotline. Even when a temperature of the refrigerant is maintained at a low level due to the gliding temperature difference of the non-azeotropic mixed refrigerant, it is possible to perform a reduction effect of dew formation by the hotline.

The refrigerating apparatus may further include a regenerative heat exchanger configured to exchange heat between the non-azeotropic mixed refrigerant discharged from the evaporator and the non-azeotropic mixed refrigerant flowing through the expander. Therefore, it is possible to further increase thermal efficiency.

The non-azeotropic mixed refrigerant may include isobutane and propane, and the isobutane may have a weight ratio of 50%≤isobutane≤90%, thereby obtaining optimum refrigeration efficiency. For the optimum efficiency of the refrigerating system, the gliding temperature difference of the non-azeotropic mixed refrigerant may be provided to be greater than 4° C.

According to embodiments disclosed herein, a refrigerating apparatus may include a main body in which an article may be accommodated, a door configured to open and close an opening of the main body, a compressor configured to compress a non-azeotropic mixed refrigerant, a condenser configured to condense the compressed non-azeotropic mixed refrigerant, a hotline provided at a contact portion between the main body and the door through which the non-azeotropic mixed refrigerant passing through the condenser may flow, an expander configured to expand the non-azeotropic mixed refrigerant, heat of which may be radiated in the hotline, and an evaporator configured to evaporate the expanded non-azeotropic mixed refrigerant to supply cold air. The compressor may be configured to control at least one of a frequency or a stoke, such that the compressor is capable of performing a continuous operation mode in which the compressor continuously operates without stopping. In the continuous operation mode, the non-azeotropic mixed refrigerant may continue to flow such that heat of the non-azeotropic mixed refrigerant may be released in or at the hotline. According to embodiments disclosed herein, it is possible to effectively prevent dew formation using the hotline under conditions of use of the non-azeotropic mixed refrigerant.

The refrigerating apparatus may further include an edge condenser provided between the condenser and the expander. Therefore, an amount of condensation heat may be increased. Even when a large cooling power is required, the refrigerating apparatus may operate sufficiently.

The refrigerating apparatus may further include a valve configured to control an opening degree at any position of the edge condenser and the hotline. It is possible to control a relative amount of the non-azeotropic mixed refrigerant flowing to the edge condenser and the hotline. Therefore, it is possible to stably secure the non-azeotropic mixed refrigerant flowing through the hotline.

Advantageous Effects

According to embodiments disclosed herein, even when the non-azeotropic mixed refrigerant is used, the function of the hotline to prevent dew formation can be normally performed with the hot refrigerant.

DESCRIPTION OF DRAWINGS

FIG. 1 is a schematic temperature graph of a non-azeotropic mixed refrigerant and air in a counterflow evaporator;

FIG. 2 is a graph showing a temperature difference between an inlet and an outlet of an evaporator and a gliding temperature difference of a non-azeotropic mixed refrigerant according to compositions of isobutane and propane;

FIG. 3A is a graph showing a refrigeration cycle when isobutane is used as the refrigerant;

FIG. 3B is a graph showing a refrigeration cycle when a non-azeotropic mixed refrigerant is used as the refrigerant; and FIG. 4 is a view showing a refrigerating apparatus according to an embodiment.

FIG. 5 is a schematic view of a refrigerating system applicable to a refrigerating apparatus according to an embodiment;

FIG. 6 is a schematic view of an evaporator and capillary tubes;

FIG. 7 is a schematic showing temperature change in a refrigerant pipe and compressor suction pipe in a regenerative heat exchanger;

FIG. 8 is a partial view of a refrigerating system, in which a regenerative heat exchanger is exaggerated;

FIG. 9 is a schematic view of an evaporator and capillary tubes in a parallel 1-compression 2-evaporation system;

FIGS. 10A-10B are temperature graphs explaining heat exchange reversal region in a parallel 1-compression 2-evaporation system;

FIG. 11 is a view for explaining an action of a hotline in a refrigerating apparatus according to an embodiment;

FIG. 12 is a view for explaining a flow order of a non-azeotropic mixed refrigerant with respect to a hotline;

FIG. 13 is a view for explaining a cycle of a refrigerating apparatus according to another embodiment; and FIG. 14 is a graph showing temperature according to a continuous operation mode for preventing dew formation.

BEST MODE

Hereinafter, embodiments will be described with reference to the accompanying drawings. The embodiments are not limited to the embodiments discussed hereinafter, and those skilled in the art who understand the spirit will be able to easily propose other embodiments falling within the scope by adding, modifying, and deleting components. However, this also falls within the spirit.

First, a non-azeotropic mixed refrigerant that is preferably applicable is presented. In the description related to the selection of the non-azeotropic mixed refrigerant, contents of the present disclosure are divided into technical elements and described in detail. First, a process of selecting a type of a non-azeotropic mixed refrigerant will be described.

Selection of Type of Non-Azeotropic Mixed Refrigerant

Refrigerants to be mixed, which are suitable for the non-azeotropic mixed refrigerant, are proposed. As the refrigerant to be mixed, a hydrocarbon-based (HC-based) refrigerant may be selected. Hydrocarbon-based refrigerant is an eco-friendly refrigerant having a low ozone depletion potential (ODP) and a low global warming potential (GWP). The criteria for selecting a refrigerant suitable for the non-azeotropic mixed refrigerant among hydrocarbon-based refrigerants may be summarized as follows.

First, from a viewpoint of compression work, when a difference (pressure difference (LP)) between a condensing pressure (Pd or p1) and an evaporation pressure (Ps or p2) is smaller, compression work of the compressor is further reduced, which is advantageous for efficiency. Therefore, refrigerants having a low condensing pressure and a high evaporation pressure may be selected. However, considering reliability of compressors, an evaporation pressure of 50 kPa or more may be selected.

Second, from a viewpoint of utilization of production facilities, refrigerants may be selected which have been used in the past for compatibility of existing facilities and components. Third, from a viewpoint of purchase costs of refrigerants, refrigerants obtainable at low cost may be selected. Fourth, from a viewpoint of safety, refrigerants that are not harmful to humans when refrigerant leaks may be selected.

Fifth, from a viewpoint of reducing irreversible loss, reduction of a temperature difference between a refrigerant and cold air so as to increase efficiency of a cycle is desirable. Sixth, from a viewpoint of handling, refrigerants that can be conveniently handled at a time of work and may be conveniently injected by handlers may be selected.

The above criteria for selecting refrigerants is variously applied in selecting the non-azeotropic mixed refrigerant.

Classification and Selection of Hydrocarbons

Based on evaporation temperature (Tv), candidate refrigerants suggested by the National Institute of Standards and Technology are classified into three (upper, middle, and lower) groups in descending order of evaporation temperature. A density of refrigerant is higher as evaporation temperature increases.

A combination of candidate refrigerants capable of exhibiting an evaporation temperature of −20° C. to −30° C. suitable for the environment of refrigerating apparatuses may be selected. Hereinafter, classification of the candidate refrigerants will be described.

The candidate refrigerants are classified into three types based on boundary values of evaporation temperature, that is, −12° C. and −50° C. The candidate refrigerants classified into the three types are shown in Table 1. It can be seen that the classification of the evaporation temperature changes greatly based on the boundary values.

TABLE 1

| No. | group | Hydrocarbon name | Evaporation temperature (1 bar) | Evaporation temperature (20 bar) ° C. | Triple point temperature |
|---|---|---|---|---|---|
| 1 | upper | isopentane | 27.5 | 154.7 | −159.85 |
| 2 | | 1,2-butadiene | 10.3 | 124.8 | −136.25 |
| 3 | | n-butane | −0.9 | 114.5 | −138.25 |
| 4 | | butene | −6.6 | 105.8 | −185.35 |
| 5 | | isobutane | −12 | 100.7 | −159.65 |
| 6 | middle | propadiene | −34.7 | 68.2 | −136.25 |
| 7 | | propane | −42.4 | 57.3 | −187.71 |
| 8 | | propylene | −47.9 | 48.6 | −185.26 |
| 9 | lower | ethane | −88.8 | −7.2 | −182.80 |
| 10 | | ethylene | −104 | −29.1 | −169.15 |

Referring to Table 1, refrigerants that may be mixed as the non-azeotropic mixed refrigerant may be selected and combined in each region. First, which group is selected among the three groups will be described. There may be one case in which refrigerants are selected from the three groups and three refrigerants are mixed, and three cases in which refrigerants are selected from two groups and two refrigerants are mixed.

When at least one refrigerant is selected from each of the three groups and three or more refrigerants are mixed, the temperature rise and drop in the non-azeotropic mixed refrigerant may be excessively great. In this case, design of the refrigerating system may be difficult.

Thus, the non-azeotropic mixed refrigerant may be obtained by selecting at least one refrigerant from each of two groups. At least one refrigerant may be selected from each of the middle group and the lower group, from each of the upper group and the middle group, and from each of the upper group and the lower group. Among them, a composition in which at least one refrigerant selected from each of the upper group and the middle group is mixed may be provided as the non-azeotropic mixed refrigerant.

When at least one refrigerant selected from each of the middle group and the lower group is mixed, the evaporation temperature of the refrigerant is excessively low. Thus, a difference between interior temperature and the evaporation temperature of the refrigerant is excessively great in a general refrigerating apparatus. Therefore, efficiency of the refrigeration cycle deteriorates and power consumption increases.

When at least one refrigerant selected from each of the upper group and the lower group is mixed, a difference in evaporation temperature between the at least two refrigerants is excessively great. Therefore, unless a special high-pressure environment is created, each refrigerant is classified into a liquid refrigerant and a gaseous refrigerant under actual use conditions. For this reason, it is difficult to inject the at least two refrigerants together into a refrigerant pipe.

Selection of Hydrocarbons in Groups of Hydrocarbons

Which refrigerant is selected from the upper group and the middle group will be described hereinafter.

First, the refrigerant selected from the upper group will be described. At least one refrigerant selected from the upper group may be used as the non-azeotropic mixed refrigerant.

As isopentane and butadiene have a relatively high evaporation temperature, the inner temperature of the evaporator of the refrigerating apparatus is limited and freezing efficiency deteriorates. Isobutane and N-butane may be used without changing components of the refrigeration cycle, such as the compressor of the refrigerating apparatus, currently used. Therefore, their use is most expected among the refrigerants included in the upper group.

N-butane has a smaller compression work than isobutane, but has a low evaporation pressure (Ps), which may cause a problem in the reliability of the compressor. For this reason, isobutane may be selected from the upper group. As described above, selection of at least one from the other hydrocarbons included in the upper group is permissible.

The refrigerant selected from the middle group will be described hereinafter. At least one refrigerant selected from the middle group may be used in the non-azeotropic mixed refrigerant.

As propadiene has a smaller pressure difference (ΔP) than that of propane, efficiency is high. However, propadiene is expensive and harmful to respiratory systems and skin when humans inhale due to leakage. Propylene has a greater pressure difference than that of propane, and thus, compression work of the compressor is increased.

For this reason, propane may be selected from the middle group. As described above, selection of at least one from the other hydrocarbons included in the middle group is permissible.

For reference, isobutane may also be referred to as R600a, and propane may also be referred to as R290. Although isobutane and propane may be selected, other hydrocarbons belonging to the same group may be applied in obtaining properties of the non-azeotropic mixed refrigerant, even where there is no specific mention in the following description. For example, if it is possible to obtain a similar gliding temperature difference of the non-azeotropic mixed refrigerant, other compositions than isobutane and propane may be used.

Selection of Ratio of Selected Hydrocarbon Refrigerant, Considering Power Consumption of Compression Work As the refrigerant to be mixed in the non-azeotropic mixed refrigerant, isobutane is selected from the upper group and propane is selected from the middle group. Ratios of the refrigerants to be mixed in the non-azeotropic mixed refrigerant may be selected as follows.

Power consumption of the compressor, which is a main energy consumption source of the refrigerating system, depends on the pressure difference. In other words, as the pressure difference is increases, more compression work needs to be consumed. As the compression work increases, efficiency of the cycle further deteriorates.

Isobutane has a smaller pressure difference (ΔP) than that of propane. For this reason, the non-azeotropic mixed refrigerant may be provided with a weight ratio of isobutane of 50% or more and a weight ratio of propane of 50% or less.

In the case of a composition in which the non-azeotropic mixed refrigerant includes isobutane and propane mixed at a ratio of 5:5, the condensing pressure is 745.3 kPa, the evaporation pressure is 120.5 kPa, and the pressure difference is 624.7 kPa. In the case of a composition in which the non-azeotropic mixed refrigerant is substantially isobutane with a very small amount of propane, the condensing pressure is 393.4 kPa, the evaporation pressure is 53.5 kPa, and the pressure difference is 340.0 Pa.

The pressure is obtained by measuring an average value when the compressor is turned on under ISO power consumption measurement conditions. All values related to the composition of the non-azeotropic mixed refrigerant are obtained under the same conditions.

Ranges of the condensing pressure, the evaporation pressure, and the pressure difference of the non-azeotropic mixed refrigerant may be known using a mixing ratio of isobutane to propane that can reduce the compression work as described above.

Selection of Ratio of Selected Hydrocarbon Refrigerant, Considering Irreversible Loss of Evaporator As described above, the non-azeotropic mixed refrigerant has a gliding temperature difference (GTD) upon phase change. Using the gliding temperature difference, evaporators may be sequentially installed in a freezer compartment and a refrigerating compartment to provide an appropriate temperature atmosphere for each partitioned space. According to the gliding temperature difference, a temperature difference between air and refrigerant evaporated in each evaporator may be reduced, thereby reducing irreversibility occurring during heat exchange. Reduction in irreversible loss may reduce the loss of the refrigerating system.

FIG. 1 is a schematic temperature graph of a non-azeotropic mixed refrigerant and air in a counterflow evaporator. In FIG. 1, the horizontal axis represents progress distance, and the air and the non-azeotropic mixed refrigerant move in opposite directions as indicated by arrows. In FIG. 1, the vertical axis represents temperature. Referring to FIG. 1, 1 is a line for air, 2 is a line for the non-azeotropic mixed refrigerant, 3 is a line for temperature rise of the non-azeotropic mixed refrigerant, 4 is a line for temperature drop of the non-azeotropic mixed refrigerant, and 5 is a line for a single refrigerant.

Referring to the line 1 for air, for example, the temperature of the air may drop from a range of −20° C. to −18° C. and the air may pass through the evaporator. Referring to the line 2 for the non-azeotropic mixed refrigerant, the temperature of the non-azeotropic mixed refrigerant may rise from −27° C. and the non-azeotropic mixed refrigerant may pass through the evaporator. The gliding temperature difference of the non-azeotropic mixed refrigerant may change according to the ratio of isobutane to propane. When the gliding temperature difference is increased, the line 2 for the non-azeotropic mixed refrigerant may move toward the line 3 for the temperature rise of the non-azeotropic mixed refrigerant. When the gliding temperature difference is decreased, the line 2 for the non-azeotropic mixed refrigerant may move toward the line 4 for the temperature drop of the non-azeotropic mixed refrigerant. For reference, as there is no phase change in the single refrigerant, there is no temperature change in the line 5 for the single refrigerant.

Irreversible loss when heat exchange occurs cannot be avoided due to the temperature difference between two interfaces where heat exchange occurs. For example, when there is no temperature difference between interfaces of two objects that exchange heat with each other, there is no irreversible loss, but heat exchange does not occur.

However, there are various methods for reducing irreversible loss due to heat exchange. A representative method is to configure a heat exchanger with counterflow. A counterflow heat exchanger may reduce irreversible loss by allowing the temperature difference between moving fluids to be reduced as much as possible.

In the case of an evaporator to which the non-azeotropic mixed refrigerant is applied, the heat exchanger may be configured with counterflow as shown in FIG. 1. As the temperature of the non-azeotropic mixed refrigerant is increased during evaporation due to the gliding temperature difference, the temperature difference between the air and the non-azeotropic mixed refrigerant may be reduced. When the gliding temperature difference of the non-azeotropic mixed refrigerant and the temperature difference of the air are reduced, irreversible loss may be reduced and efficiency of the refrigeration cycle may be increased.

The gliding temperature difference of the non-azeotropic mixed refrigerant may not be increased infinitely due to limitations of the refrigerant. In addition, when the gliding temperature difference of the non-azeotropic mixed refrigerant is changed, the gliding temperature difference of the cold air is changed. Accordingly, a size of the evaporator is changed and total efficiency of the refrigeration cycle is affected. For example, when the gliding temperature difference is increased, the inlet temperature of the refrigerant is decreased or the outlet temperature of the refrigerant is overheated, thus reducing efficiency of the refrigeration cycle.

On the other hand, the gliding temperature difference of the non-azeotropic mixed refrigerant and the temperature difference of the air may converge to zero if a size of the heat exchanger is infinitely large. However, considering mass productivity and cost reduction of the heat exchanger, in the case of a general refrigerating apparatus, the gliding temperature difference of the non-azeotropic mixed refrigerant and the temperature difference of the air are about 3° C. to 4° C.

FIG. 2 is a graph showing a temperature difference between an inlet and an outlet of an evaporator and a gliding temperature difference of a non-azeotropic mixed refrigerant according to compositions of isobutane and propane. The horizontal axis represents a content of isobutane, and the vertical axis represents a temperature difference.

Referring to FIG. 2, when isobutane and propane are each included in 100%, there is no temperature change while isobutane and propane undergo evaporation as a single refrigerant. When isobutane and propane are mixed, there are the gliding temperature difference of the non-azeotropic mixed refrigerant and the temperature difference between the inlet and the outlet of the evaporator. A temperature difference 11 between the inlet and the outlet of the evaporator is smaller than a gliding temperature difference 12 of the non-azeotropic mixed refrigerant. This may be caused by incomplete heat transfer between the refrigerant and air.

When the gliding temperature difference of the non-azeotropic mixed refrigerant is greater than the temperature difference between the inlet and the outlet of the evaporator, characteristics of the non-azeotropic mixed refrigerant may be well utilized. Also, it is advantageous from a viewpoint of reducing irreversibility in heat exchange and increasing efficiency of the refrigeration cycle. Likewise, the gliding temperature difference of the non-azeotropic mixed refrigerant may be greater than the temperature difference of the air passing through the evaporator.

In a general refrigerating apparatus, the temperature difference of the air passing through the inlet and the outlet of the evaporator may reach 4° C. to 10° C. In most cases, the temperature difference of air is close to 4° C. For this reason, the gliding temperature difference of the non-azeotropic mixed refrigerant may be maintained higher than 4° C. Maintaining the gliding temperature difference to be at least 4.1° C. or higher, which is minimally higher than the temperature difference between the inlet and the outlet of the evaporator, may be advantageous. When the gliding temperature difference of the non-azeotropic mixed refrigerant is less than 4.1° C., thermal efficiency of the refrigeration cycle may decrease.

In contrast, when the gliding temperature difference of the non-azeotropic mixed refrigerant is greater than 4.1° C., the temperature difference between the air and the refrigerant at the outlet side of the refrigerant decreases, irreversibility decreases, and thermal efficiency of the refrigeration cycle increases. That the temperature difference between the air and the refrigerant at the outlet side of the refrigerant decreases means that the line 2 for the non-azeotropic mixed refrigerant moves toward the line 3 for the temperature rise of the non-azeotropic mixed refrigerant in FIG. 1.

In FIG. 2, when the gliding temperature difference of the non-azeotropic mixed refrigerant is 4.1° C., isobutane is 90%, and when the gliding temperature difference of the non-azeotropic mixed refrigerant is greater than 4.1° C., isobutane is less than 90%. In order to minimize compression work of the compressor, isobutane may be 50% or more.

As a result, a weight ratio of the non-azeotropic mixed refrigerant provided as isobutane and propane may be expressed as in Equation 1.

$$50\% \leq \text{isobutane} \leq 90\% \quad \text{[Math Figure 1]}$$

Propane is the remaining or other component in the weight ratio of the non-azeotropic mixed refrigerant.

As the gliding temperature difference of the non-azeotropic mixed refrigerant increases, irreversible loss may be reduced. However, when the gliding temperature difference is excessively great, a size of the evaporator becomes excessively large in order to secure a sufficient heat exchange passage between the refrigerant and the air. A space inside of the refrigerating apparatus may be secured when the evaporator applied to a general household refrigerating apparatus is designed with a capacity of 200 W or less. For this reason, the gliding temperature difference of the non-azeotropic mixed refrigerant may be limited to 7.2° C. or less.

In addition, when the gliding temperature difference of the non-azeotropic mixed refrigerant is excessively great, the temperature of the inlet of the evaporator may be too low or the outlet of the evaporator outlet may be overheated too quickly, based on the non-azeotropic mixed refrigerant. An available area of the evaporator may be reduced and efficiency of the heat exchange may decrease.

At the outlet of the evaporator, the temperature of the non-azeotropic mixed refrigerant has to be higher than the temperature of the air introduced into the evaporator. Otherwise, efficiency of the heat exchanger decreases due to reversal of the temperatures of the refrigerant and air. When this condition is not satisfied, efficiency of the refrigerating system may be reduced.

In FIG. 2, when the gliding temperature difference of the non-azeotropic mixed refrigerant is 7.2° C., isobutane is 75%, and when the gliding temperature difference of the non-azeotropic mixed refrigerant is less than 7.2° C., isobutane is more than 75%. As a result, considering this condition and the condition of Equation 1 together, a weight ratio of the non-azeotropic mixed refrigerant provided as isobutane and propane may be expressed as in Equation 2.

$$75\% \leq \text{isobutane} \leq 90\% \quad \text{[Math Figure 2]}$$

Propane is the remaining or other component in the weight ratio of the non-azeotropic mixed refrigerant.

Selection of Ratio of Selected Hydrocarbon Refrigerant, Considering Compatibility of Production Facilities And Components The temperature difference between the inlet and the outlet of the evaporator of a general refrigerating apparatus may be set to 3° C. to 5° C. This is due to various factors, such components of the refrigerating apparatus, internal volume of the machine room, heat capacity of each component, and size of the fan, for example. When a composition ratio of the non-azeotropic mixed refrigerant capable of providing the temperature of the inlet and the outlet of the evaporator, that is, 3° C. to 5° C., is found in FIG. 2, it can be seen that isobutane is between 76% and 87%.

As a result of the above discussion, the non-azeotropic mixed refrigerant that satisfies all of the above-described conditions may be expressed as Equation 3.

$$76\% \leq \text{isobutane} \leq 87\% \quad \text{[Math Figure 3]}$$

Propane is the remaining or other component in the weight ratio of the non-azeotropic mixed refrigerant.

Ratio of Hydrocarbon Refrigerant to be Finally Applied

The isobutane application range that can be selected on the basis of the various criteria described above may be determined to be 81% to 82%, which is the middle range of Equation 3. Propane may occupy the remaining portion of the non-azeotropic mixed refrigerant.

The case of using only isobutane was compared with the case of using the non-azeotropic mixed refrigerant in which 85% of isobutane and 15% of propane were applied. In both cases, the evaporators were constructed in parallel to form the cycle of the refrigerating system.

The experimental conditions were −29° C. and −15° C. and the inlet temperatures of the compressors were 25° C., respectively. Due to the difference in the refrigerant, the temperature of the condenser was 31° C. when using only isobutane and 29° C. when using the non-azeotropic mixed refrigerant.

FIGS. 3A and 3B are tables for comparison of the refrigeration cycle in each case. FIG. 3A is a graph showing the refrigeration cycle when only isobutane is used in parallel, and FIG. 3B is a graph showing the refrigeration cycle when the non-azeotropic mixed refrigerant is used.

In the experiment according to FIGS. 3A-3B, it can be seen that when the non-azeotropic mixed refrigerant is used, improvement in coefficient of performance was approximately 4.5%.

FIG. 4 is a view showing a refrigerating apparatus according to an embodiment. Referring to FIG. 4, a refrigerating apparatus according to an embodiment may include a machine room 31, a freezer compartment 32, and a refrigerating compartment 33. The refrigerating apparatus forms a refrigeration cycle that uses the non-azeotropic mixed refrigerant. In the refrigeration cycle, a compressor 21 that compresses the refrigerant, an expander 22 that expands the compressed refrigerant, a condenser 23 that condenses the expanded refrigerant, and first and second evaporators 24 and 25 that evaporates the condensed refrigerant may be included.

The compressor 21, the expander 22, and the condenser 23 may be provided in the machine room 31. The first evaporator 24 may be provided in the freezer compartment 32. The second evaporator 25 may be provided in the refrigerating compartment 33. The freezer compartment and the refrigerating compartment may be referred to as an "interior space".

A temperature of the non-azeotropic mixed refrigerant may be lower in the first evaporator 24 than in the second evaporator 25. As the first evaporator 24 is placed in the freezer compartment 32, the refrigerating system may be operated more appropriately in a partitioned space of the refrigerating apparatus. Therefore, irreversible loss may be further reduced in the evaporation operation of the evaporator.

FIG. 5 is a schematic view of a refrigerating system applicable to a refrigerating apparatus according to an embodiment. Referring to FIG. 5, the refrigerating system according to this embodiment may include a compressor 110 that compresses a refrigerant, a condenser 120 that condenses the compressed refrigerant, and evaporators 150 and 160 that evaporate the refrigerant condensed by the condenser 120. The refrigerant evaporated by the evaporators 150 and 160 may circulate to the compressor 110.

The evaporators 150 and 160 may include first evaporator 150 capable of supplying cold air to a freezer compartment and second evaporator 160 capable of supplying cold air to a refrigerating compartment. A three-way valve 130 capable of branching and supplying the condensed refrigerant to the evaporators 150 and 160 may be further provided. The three-way valve 130 may selectively supply the refrigerant supplied from the condenser 120 to the first evaporator 150 or the second evaporator 160. The three-way valve 130 may be a multi-directional valve that branches introduced refrigerant to at least two places. As the three-way valve 130 branches the refrigerant in multiple directions, the three-way valve 130 may also be referred to as a "multi-directional valve".

The refrigerant heat-exchanged in the first evaporator 150 may be supplied to the second evaporator 160. The refrigerant may be a non-azeotropic mixed refrigerant and a temperature of the refrigerant may rise during evaporation. The first evaporator 150 may evaporate the refrigerant at a lower temperature than the second evaporator 160. Therefore, the first evaporator 150 may be more suitable for supplying cold air to the freezer compartment, and the second evaporator 160 may be more suitable for supplying cold air to the refrigerating compartment.

The first evaporator 150 and the second evaporator 160 may be connected in series based on a refrigerant flow. These advantages are remarkable as compared to a case of using a single refrigerant or an azeotropic mixed refrigerant.

Advantages of the non-azeotropic mixed refrigerant when two evaporators are used in a single compressor will be described hereinafter.

First, a refrigerating system using two evaporators in a single compressor (hereinafter, simply referred to as a "1-compression 2-evaporation system") may use a single refrigerant or an azeotropic mixed refrigerant, a temperature of which does not change during evaporation. The evaporators may include a refrigerating compartment evaporator that supplies cold air to the refrigerating compartment and a freezer compartment evaporator that supplies cold air to the freezer compartment.

In this case, when the two evaporators are connected in parallel, the refrigerant concentrates in the freezer compartment evaporator increasing irreversible loss and control is difficult. In contrast, when the two evaporators are connected in series, a thermal insulation load in the freezer compartment is large, and thus, refrigerant has to be supplied to the freezer compartment evaporator after passing through the refrigerating compartment evaporator. This is because the refrigerant has to remain in the freezer compartment evaporator for a long time in order to cope with the thermal insulation load of the freezer compartment.

The three-way valve may be installed upstream of the refrigerating compartment evaporator. According to the three-way valve, the refrigerant may be supplied to the freezer compartment evaporator without passing through the refrigerating compartment evaporator. In this manner, overcooling of the refrigerating compartment corresponding to the refrigerating compartment evaporator may be prevented. This may be referred to as a "serial bypass 1-compression 2-evaporation system".

The serial bypass 1-compression 2-evaporation system is difficult to accurately control because a flow rate control of refrigerant corresponding to the interior space and intermittent control of the three-way valve corresponding to change in thermal insulation loads of the refrigerating compartment and freezer compartment are continuously required. In addition, as refrigerant of different states passing through different passages are continuously mixed, irreversible loss increases and power consumption increases.

As a solution to this problem, a non-azeotropic mixed refrigerant may be used in a 1-compression 2-evaporation system. The temperature of the non-azeotropic mixed refrigerant rises during evaporation. Using this property, the refrigerant may be supplied to the refrigerating compartment evaporator after passing through the freezer compartment evaporator. In this case, while the non-azeotropic mixed refrigerant is evaporated, cold air may be supplied to the freezer compartment at a first temperature corresponding to a temperature of the freezer compartment, and cold air may be supplied to the refrigerating compartment at a second temperature corresponding to a temperature of the refrigerating compartment. The second temperature may be higher than the first temperature.

The gliding temperature difference of the non-azeotropic mixed refrigerant may be used such that the refrigerant flows into two evaporators in series. Therefore, irreversible loss caused by the mixing of refrigerants having different properties may be reduced. Therefore, power consumption may be reduced.

The refrigerating system according to this embodiment may be referred to as a "serial bypass 1-compression 2-evaporation" system in which the three-way valve 130 is located upstream of the first evaporator 150 and the second evaporator 160. Due to the three-way valve 130, the refrigerant may be supplied to both of the evaporators 150 and 160, or the refrigerant may bypass the first evaporator 150 and may be supplied to only the second evaporator 160. In other words, operation of the refrigerating compartment (flow B in FIG. 5) alone, and simultaneous operation of the refrigerating compartment and the freezer compartment (flow A in FIG. 5) are possible.

The operation of the freezer compartment alone reduces a frequency of the compressor with respect to the simultaneous operation of the refrigerating compartment and the freezer compartment, thus lowering freezer capacity. Therefore, operation of the freezer compartment alone may be performed by evaporating all of the refrigerant in the first evaporator 150 corresponding to the freezer compartment. A fan of the refrigerating compartment may be turned off by another method or a combined method.

In all modes of operation of the refrigerating compartment alone, simultaneous operation of the refrigerating compartment and the freezer compartment, and operation of the freezer compartment alone, the temperature of the non-azeotropic mixed refrigerant increases in the second evaporator 160 corresponding to the refrigerating compartment, and thus, fear of overcooling in the refrigerating compartment may be reduced. When the single refrigerant or the azeotropic mixed refrigerant is used, the temperature is the same in the evaporation process. Therefore, supercooling in the second evaporator 160 may be avoided.

A first capillary tube 140 may be provided in a connection passage of the first evaporator 150 among discharge sides of the three-way valve 130. A second capillary tube 145 may be provided in a connection passage of the second evaporator 160 among discharge sides of the three-way valve 130. Each of the capillary tubes 140 and 145 may be referred to as an "expander".

The first capillary tube 140 may expand the non-azeotropic mixed refrigerant to supply the refrigerant to the first evaporator 150. The second capillary tube 145 may expand the non-azeotropic mixed refrigerant to supply the refrigerant to the second evaporator 160.

A refrigerant outlet side of the first evaporator 150 may be connected to a refrigerant inlet side of the second evaporator 160. The refrigerant outlet side of the first evaporator 150 may be connected to a refrigerant outlet side of the second capillary tube 145.

A check valve 155 may be provided in a connection pipe between the first evaporator 150 and the second evaporator 160, that is, immediately downstream of the first evaporator 150. The check valve 155 may allow refrigerant flow from the first evaporator 150 to the second evaporator 160 and may not allow reverse flow in an opposite direction. Therefore, reverse flow of the refrigerant may be prevented when switching from simultaneous operation of the freezer compartment and the refrigerating compartment to operation of the refrigerating compartment alone.

A gas-liquid separator may not be suitable to be installed in the connection pipe between the first evaporator 150 and the second evaporator 160. This is because if only gas is passed in the non-azeotropic mixed refrigerant that has only partially evaporated in the first evaporator 150, sufficient cooling power may not be supplied to the second evaporator 160. In other words, the non-azeotropic mixed refrigerant may not maintain the mixing ratio of the two refrigerants in the liquid phase and the gas phase.

The gas-liquid separator 165 may be provided at the outlet side of the second evaporator 160. The gas-liquid separator 165 allows only the gas refrigerant to be discharged to the compressor 110, thereby preventing damage and noise of the compressor 110 and improving efficiency.

A compressor suction pipe 170, which connects the second evaporator 160 to the compressor 110, and the capillary tubes 140 and 145 may exchange heat with each other. Therefore, heat of the capillary tubes 140 and 145 may be transferred to the compressor suction pipe 170, such that refrigerant introduced into the compressor 110 may maintain a gas state. The cold air of the compressor suction pipe 170 may be transferred to the capillary tubes 140 and 145 to prevent cold air loss and reduce power consumption.

The compressor suction pipe 170 may exchange heat with at least one of the capillary tubes 140 and 145. In the simultaneous operation of the freezer compartment and the refrigerating compartment and the operation of the freezer compartment alone, the compressor suction pipe 170 and the first capillary tube 140 may exchange heat with each other. In the operation of the refrigerating compartment alone, the compressor suction pipe 170 and the second capillary tube 145 may exchange heat with each other. Therefore, cold air loss may be reduced in each mode and efficiency of the refrigeration cycle may be increased.

The compressor suction pipe 170 may exchange heat with both of the capillary tubes 140 and 145. Therefore, cold air loss may be reduced in all operation modes. The compressor suction pipe 170, the first capillary tube 140, and the second capillary tube 145 may be provided at positions adjacent to each other to exchange heat with each other.

The serial bypass 1-compression 2-evaporation system has at least the following advantages. First, the gliding temperature difference of the non-azeotropic mixed refrigerant is provided in the order of the freezer compartment and the refrigerating compartment, thereby reducing irreversible loss and reducing power consumption. Second, operation of the refrigerating compartment alone, operation of the freezer compartment alone, and simultaneous operation of the freezer compartment and the refrigerating compartment may all be stably performed.

As the refrigerant of embodiments, the non-azeotropic mixed refrigerant, the temperature of which rises during evaporation, is used. Therefore, a temperature at outlet sides of the capillary tubes 140 and 145 may be higher than a temperature at an outlet side of the second evaporator 160. Due to this, a heat exchange reversal phenomenon may occur. The heat exchange reversal phenomenon will be described hereinafter.

FIG. 6 is a schematic view of the evaporator and the capillary tubes, showing temperature of each point. Temperature reversal of the regenerative heat exchanger in the case of using the non-azeotropic mixed refrigerant will be described with reference to FIG. 6.

FIG. 6 shows the first evaporator 150, the second evaporator 160, and the regenerative heat exchanger 180 in which heat exchange between the compressor suction pipe 170 and the capillary tubes 140 and 145 is performed. FIG. 6 shows simultaneous operation of the freezer compartment and the refrigerating compartment.

Each point on the drawing is marked with a P, the first number 1 after the P represents the inlet side of the first capillary tube, and the first number 2 after the P represents the inlet side of the compressor suction line. The second number after the P represents an order of progress.

The refrigerant introduced through the inlet of the first capillary tube 140 flows through passages of points P11, P12, P13, and P14. The refrigerant introduced through the inlet of the compressor suction pipe 170 flows through passages of points P21 and P22. The regenerative heat exchanger 180 may correspond to a zone indicated by an arrow.

A temperature of the refrigerant flowing through the first capillary tube 140 in the region of the regenerative heat exchanger 180 drops from 31° C. to −27° C. (P11→P12). A temperature of the refrigerant flowing through the compressor suction pipe 170 in the region of the regenerative heat exchanger 180 rises from 0° C. to 25° C. (P21→P22). Therefore, a heat exchange reversal region in which heat exchange between the capillary tube and the compressor suction pipe is reversed may occur in the region of the regenerative heat exchanger 180.

The heat exchange reversal region may be a factor that decreases efficiency of heat exchange and increases power consumption. In the drawing, the vertically extending arrow schematically indicates a region in which the regenerative heat exchanger 180 is provided.

The refrigerant passing through the point P12 may pass through the first evaporator 150. When the refrigerant passes through the first evaporator 150, the refrigerant is discharged at −20° C. from the point P13 and is introduced into the second evaporator 160. The refrigerant further evaporated by the second evaporator 160 is discharged at 0° C. from the point P14 at the outlet side of the second evaporator 160. The point P14 and the point P21 may be 0° C. as the same point.

FIG. 7 is a schematic view of temperature change in a refrigerant pipe and compressor suction pipe in the regenerative heat exchanger. Referring to FIG. 7, the heat exchange direction is reversed at a point T. It can be seen that the heat exchange reversal region is after the point T based on the progress direction of the capillary tubes.

In the heat exchange reversal region, cold air from the capillary tubes is transferred toward the compressor suction pipe. This phenomenon causes loss of heat exchange in the evaporator, and thus, should be avoided.

The refrigerating system may be reconfigured to remove the heat exchange reversal region, but this is difficult in terms of common use of production facilities and components. The structure in which the heat exchange reversal region itself disappears in the regenerative heat exchanger will be described hereinafter.

FIG. 8 is a partial view of a refrigerating system, in which a regenerative heat exchanger is exaggerated. Referring to FIG. 8, the regenerative heat exchanger 180 is shown with a dashed line. In the regenerative heat exchanger (SLHX: Suction Line Heat Exchanger), heat exchange may be performed in such a manner that the capillary tube and the compressor suction pipe come into contact with each other or are adjacent to each other.

Under the control of the three-way valve 130, the refrigerant may flow into at least one of the first capillary tube 140 or the second capillary tube 145. In the drawing, the refrigerant passing through the capillary tubes 140 and 145 may flow from top to bottom, that is, downward. The refrigerant discharged from the second evaporator 160 may flow through the compressor suction pipe 170. In the drawing, the refrigerant flowing through the compressor suction pipe 170 may flow from bottom to top, that is, upward. As the drawing is for convenience of understanding, the direction may be left and right.

The refrigerant flowing through the capillary tube and the refrigerant flowing through the compressor suction pipe flow counterflow and exchange heat with each other. As described above, the heat exchange reversal region may occur in the regenerative heat exchanger 180. Therefore, for the heat exchange reversal region, the refrigerant in the capillary tube and the refrigerant in the compressor suction pipe may not exchange heat with each other.

Based on the drawing, the regenerative heat exchanger 180 forms a heat exchange region A1 in which heat exchange is performed at an upper portion of point T, and a shielding region A2 in which heat exchange is shielded at a lower portion of point T. The heat exchange region A1 may be a geometric region from point T to the three-way valve. The shielding region A2 may be a geometric region from point T to the evaporator.

The temperature at the point T may fluctuate according to operating conditions of the cycle of the refrigerating system. The temperature at the point T may be within a range of −5° C. to 5° C.

A pipe length L1 of the shielding region A2 may be about 1 m. The point T may be placed at about 1 m from the outlet of the capillary tube and the inlet of the compressor suction pipe. That is, the shielding region may be included within about 1 m or less from the outlet of the capillary tube and the inlet of the compressor suction pipe.

In the shielding region A2, two pipe conduits may not come into contact with each other in order to shield heat exchange between the outlet of the capillary tube and the compressor suction pipe. For example, the two pipe conduits may not be welded together. In contrast, in the heat exchange region A1, two pipe conduits may be brought into contact with each other by a method, such as welding. However, in order to allow uniform heat exchange to be performed in the regenerative heat exchanger, indirect heat exchange with low heat exchange performance may be performed. In this case, it may be advantageous to prevent all the pipe conduits from being brought into contact with each other by a method, such as welding.

Due to the gliding temperature difference of the non-azeotropic mixed refrigerant, the heat exchange reversal region occurs not only in the serial bypass 1-compression 2-evaporation system, but also in the parallel 1-compression 2-evaporation system. Therefore, the shielding region A2 may be provided in the regenerative heat exchanger of the refrigerating system to which the non-azeotropic mixed refrigerant is applied. The parallel 1-compression 2-evaporation system may refer to a system in which an evaporator supplying cold air to the freezer compartment and an evaporator supplying cold air to the refrigerating compartment are connected in parallel to supply cold air to the freezer compartment and the refrigerating compartment.

Generation of a heat exchange reversal region in a parallel 1-compression 2-evaporation system will be described with reference to FIGS. 9 and 10.

FIG. 9 is a schematic view of an evaporator and a capillary tubes in a parallel 1-compression 2-evaporation system. FIG. 10A is a temperature graph explaining a heat exchange reversal region in a parallel 1-compression 2-evaporation system when a single refrigerant is used. FIG. 10B is a temperature graph explaining heat exchange reversal region in a parallel 1-compression 2-evaporation system when the non-azeotropic mixed refrigerant is used.

Referring to FIG. 9, the parallel 1-compression 2-evaporation system may include a refrigerant supplier 190 that branches the condensed refrigerant to two evaporators, and first evaporator 150 and second evaporator 160 that evaporate the refrigerant supplied from the refrigerant supplier 190 and supply cold air. The first evaporator 150 may be an evaporator that supplies cold air to the freezer compartment, and the second evaporator 160 may be an evaporator that supplies cold air to the refrigerating compartment.

As the refrigerant is the non-azeotropic mixed refrigerant, the temperature of the non-azeotropic mixed refrigerant rises due to the gliding temperature difference during evaporation. Therefore, the shielding region A2 may be provided in the regenerative heat exchanger 180.

It can be seen that there is no heat exchange reversal region in FIG. 10A, but the heat exchange reversal region is generated in FIG. 10B. As a result, in the case of the refrigerating system provided with the non-azeotropic mixed refrigerant and the regenerative heat exchanger, the shielding region is provided in the regenerative heat exchanger, thereby reducing power consumption.

In the refrigerating system using the non-azeotropic mixed refrigerant as a working fluid, a temperature of the refrigerant discharged from the condenser is low, as compared to the refrigerating system that provides a same refrigeration capacity and uses a single refrigerant. This is due to the gliding temperature difference.

For example, when the inlet temperature and the outlet temperature of the condenser in the refrigerating system using the single refrigerant are all 31° C., the inlet temperature and the outlet temperature of the condenser in the refrigerating system that provides the same refrigeration capacity and uses the non-azeotropic mixed refrigerant may be 33° C. and 29° C., respectively. This is due to the gliding temperature difference. A weight ratio of isobutane and propane in the non-azeotropic mixed refrigerant may be 85:15.

When the temperature of the non-azeotropic mixed refrigerant discharged from the condenser decreases, function of the hotline installed to prevent dew formation is reduced. For example, the temperature of the non-azeotropic mixed refrigerant in the hotline may drop below a certain temperature while the compressor is stopped. In this case, dew formation may occur between the main body and the door even though the hotline is installed.

A refrigerating apparatus for preventing the above-described problems, according to embodiments, will be described hereinafter.

FIG. 11 schematically shows a refrigerating apparatus according to an embodiment. A compressor 110, a condenser 120, expanders 140 and 145, and evaporators 150 and 160 may be accommodated in a machine room.

A refrigerant discharged from the condenser 120 may flow into a three-way valve 130 after passing through an edge portion of a wall of main body 300. The refrigerant discharged from the condenser 120 may flow into an internal space of an insulation wall of the refrigerating apparatus and may be cooled and then introduced into the three-way valve. The refrigerant discharged from the condenser 120 may further radiate heat into an external space of the refrigerating apparatus and then flow into the three-way valve.

Flow of the non-azeotropic mixed refrigerant between the condenser 120 and the three-way valve 13 will be described hereinafter.

The non-azeotropic mixed refrigerant a discharged from the condenser 120 may flow along a hotline 121 inside of an edge portion or edge of a front end portion or front end of the main body 300. The front end portion of the main body 300 is a portion that is in contact with door 310 and a portion in which cold air in the interior space and hot air outside of the interior space are in contact with each other. A temperature difference is large at the front end portion of the main body 300.

The non-azeotropic mixed refrigerant that flows inside of the hotline 121 may further radiate heat in addition to radiation of heat generated by the condenser 120. The hotline 121 may serve as an auxiliary condenser.

The temperature between the main body 300 and the door 310 may be maintained above a certain level by the amount of heat radiated from the hotline 121. As a result, dew formation may be prevented in or at a contact portion between the main body 300 and the door 310. Moreover, the non-azeotropic mixed refrigerant may be discharged from the condenser 120 and directly introduced into the hotline 121 without passing through another place. Therefore, the hotline 121 may maintain a state above a predetermined temperature. Likewise, there is no problem in performing the function of the hotline. An inlet of the hotline 121 and an outlet of the condenser 120 may be connected to each other by pipes having a length of several centimeters to tens of centimeters or less. Therefore, there may be substantially no heat radiation from the refrigerant.

The refrigerant discharged from the hotline 121 may be introduced into three-way valve 130. When the amount of heat radiation through the hotline 121 is sufficient, a discharge side of the hotline 121 and an inflow side of the three-way valve 130 may be connected to each other.

The refrigerant discharged from the hotline 121 may be introduced into an edge condenser 122 so as to perform additional heat radiation in addition to the hotline 121. The edge condenser 122 is a condenser that assists the hotline 121 and may be accommodated in the internal space of a rear insulation wall of the refrigerating apparatus. The edge condenser 122 may be accommodated in the edge portion of the insulation wall of the refrigerating apparatus.

The non-azeotropic mixed refrigerant 13 that is further condensed in the edge condenser 122 may be introduced into the three-way valve 130. In this case, both the hotline 121 and the edge condenser 122 may act as auxiliary condensers. FIG. 11 illustrates a case in which both the hotline and the edge condenser are provided.

At least one of a frequency or stroke of the compressor may be increased or decreased. In this manner, an amount of refrigerant circulating in the refrigerating system may be controlled.

FIG. 12 is a view for explaining a flow order of the non-azeotropic mixed refrigerant so as to show function of the hotline. Referring to FIG. 12, the refrigerant compressed by the compressor 110 may be condensed by the condenser 120. The non-azeotropic mixed refrigerant condensed by the condenser 120 may be introduced into the hotline 121 in a relatively high temperature state without passing through other heat radiation portions. The hot line 121 may be provided on or at a contact surface between the main body 300 and the door 310 on the main body 300 side and may radiate heat between the main body 300 and the door 310 and prevent dew formation on or at the contact surface between the main body 300 and the door 310.

The non-azeotropic mixed refrigerant, the heat of which may be radiated from the hotline 121, may perform heat radiation again at the edge condenser 122 to further radiate heat. Both the hotline 121 and the edge condenser 122 may be accommodated inside of the insulation wall of the main body 300 of the refrigerating apparatus. The hotline 121 and the edge condenser 122 may be sufficiently spaced apart from each other on front and rear surfaces of the main body of the refrigerating apparatus, thereby increasing heat radiation efficiency.

The non-azeotropic mixed refrigerant, heat of which may be radiated by the condenser 120, the hotline 121, and the edge condenser 122, may be expanded by the expanders 140 and 150 and then evaporated by the evaporators 150 and 160. The non-azeotropic mixed refrigerant may absorb heat from the outside, for example, the interior space, while being evaporated by the evaporators 150 and 160. With the above process, a cycle of the refrigerating system may be completed.

FIG. 13 is a view for explaining a cycle of the refrigerating apparatus according to another embodiment. In FIG. 13, contents and description of the same or similar components of FIG. 12 are applicable to this embodiment, and repetitive disclosure has been omitted.

Referring to FIG. 13, the refrigerant condensed by the condenser 120 may be branched by a branch portion or branch 123 and then introduced into the hotline 121 and the edge condenser 122. The hotline may be provided on or at the contact surface between the main body 300 and the door 310, and the edge condenser 122 may be provided on the rear surface of the main body. At least one of the hotline 121 or the edge condenser 122, for example, both of the hotline 121 and the edge condenser 122, may be accommodated in the insulation wall of the refrigerating apparatus. At least one of the hotline 121 or the edge condenser 122, for example, both of the hotline 121 and the edge condenser 122, may be located at positions close to the external space in the insulation wall of the refrigerating apparatus. The refrigerant discharged from the hotline 121 and the edge condenser 122 may be joined by the joint portion 124 and then guided to the expanders 140 and 145. The hotline 121 and the edge condenser 122 may be installed in parallel between the condenser and the expander.

Even in this embodiment, the non-azeotropic mixed refrigerant condensed by the condenser 120 may be directly introduced into the hotline 121. Therefore, it may be maintained at a temperature above a predetermined temperature, and it is possible to sufficiently prevent dew formation on or at the contact surface between the main body and the door.

In order to maintain a sufficient amount of heat radiated by the hotline 121, a valve, an opening degree of which may be controlled, may be provided at a position adjacent to at least one of the branch portion 123 or the joint portion 124. The valve may be referred to as an "opening control valve". The valve may control the opening degree of each line such that more refrigerant flows to the hotline than the edge condenser. The valve may be provided on either side of the two branched paths. In this case, the opening degree of the valve may be controlled relative to a total flow rate circulating through the refrigerating system, thereby controlling a flow rate ratio of one or a first path, on which the valve is installed, and the other or a second path. The valve may be provided at a point between the branch portion and the joint portion and may control the relative amount of refrigerant flowing through the two flow paths.

When a flow rate of the non-azeotropic mixed refrigerant flowing through the refrigerating system is insufficient, the branch portion 123 and the joint portion 124 may be controlled to allow more non-azeotropic mixed refrigerant to flow to the hotline 121. In this case, a sufficient amount of heat may be provided even in an adjacent portion of the outlet end of the hot line 121. Thereby, dew formation may be reliably prevented.

In order to prevent dew formation when the refrigerating system is intermittently operated, the opening degree of the valve may be controlled to allow more refrigerant and heat of the refrigerant to flow to the hotline 121. Details thereof will be described.

When operation of the refrigerating system is stopped, refrigerant does not flow to the hotline 121. In this case, heat radiation does not occur in the hotline 121, and dew formation may occur on or at the contact surface between the main body and the door. In order to prevent the dew formation, when the refrigerating system is operated, more heat is supplied by directing more non-azeotropic mixed refrigerant to the hotline 121 than necessary. The heat supplied when the refrigerating system is operating is radiated when the refrigerating system is not operating, and dew formation is prevented.

As such, excessive heat supplied to the hotline during operation of the refrigerating system may lead to an increase in irreversible loss due to a rapid change in temperature and a loss of cooling power due to heat permeation in the refrigerating apparatus during operation of the refrigerating apparatus. In order to prevent such a problem, the refrigerating apparatus using the non-azeotropic mixed refrigerant may be operated in a continuous operation mode. The continuous operation mode refers to a mode in which the compressor is continuously operated such that the refrigerating apparatus continuously operates without turning off the refrigerating system.

FIG. 14 is a graph showing temperature change according to a continuous operation mode for preventing dew formation. Referring to FIG. 14, in the case of an intermittent operation mode, based on interior temperature, the refrigerating system is turned on when the interior temperature exceeds a certain or predetermined temperature, and the refrigerating system is turned off when the interior temperature is below a certain or predetermined temperature.

In a state in which the refrigerating system is turned on, the interior temperature rises above a certain or predetermined level. In contrast, as the non-azeotropic mixed refrigerant does not flow to the hotline 121, the temperature drops below a certain level. In the drawing, "A" represents a state in which the temperature of the hotline 121 drops because the refrigerant does not flow in the refrigerating system. In this state, dew formation may occur on or at the contact surface between the main body and the door.

In order to prevent such dew formation, when the refrigerating system performs the continuous operation mode, the non-azeotropic mixed refrigerant always flows through the hotline 121. The non-azeotropic mixed refrigerant may maintain a temperature above a certain or predetermined level, that is, a degree at which dew formation does not occur. Arrows indicated by thick solid lines in FIG. 14 represent a rise of temperature of the hotline in the continuous operation mode.

When the refrigerating system is continuously operated in the continuous operation mode, a small amount of the non-azeotropic mixed refrigerant may flow in order to prevent excessive supply of cooling power, as compared to the case in which the refrigerating system is turned on in the intermittent operation mode. Frequency and stroke of the compressor 110 may be controlled. A compression capacity may be reduced by controlling frequency and stroke of the compressor.

More specifically, in the continuous operation mode, the compressor 110 may be continuously operated with a relatively low compression capacity. In the intermittent operation mode, the compressor 110 may repeat a cycle in which the compressor 110 is operated with a relatively high compression capacity and then turned off. Even when a small amount of the non-azeotropic mixed refrigerant flows in the refrigerating system, an amount of heat radiation required for operation of the hotline 121 may be secured.

According to embodiments disclosed herein, even in the case of a refrigerating apparatus using the non-azeotropic mixed refrigerant, dew formation on or at a contact surface between the main body and the door may be prevented. Even when a continuous operation mode is performed, the non-azeotropic mixed refrigerant condensed by the condenser may flow into the hotline without passing through other parts, components, or pipelines. However, as intermittent operation is not performed, the hotline and the condenser may not necessarily be directly connected to each other.

INDUSTRIAL APPLICABILITY

According to embodiments disclosed herein, as an amount of non-azeotropic mixed refrigerant capable of preventing dew formation may flow through a hotline, reliability of a refrigerating apparatus may be improved. Application of the non-azeotropic mixed refrigerant capable of increasing efficiency of the refrigerating system may be further accelerated.

The invention claimed is:

1. A refrigerating apparatus, comprising:

a main body having an interior space;

a door to open and close an opening of the main body;

a compressor to compress a non-azeotropic mixed refrigerant;

a condenser to condense the compressed non-azeotropic mixed refrigerant;

a hotline disposed at a contact portion between the main body and the door to flow the non-azeotropic mixed refrigerant having passed through the condenser, wherein heat of the non-azeotropic mixed refrigerant is radiated by the hotline;

an expander to expand the non-azeotropic mixed refrigerant from the hotline; and at least one evaporator to evaporate the expanded non-azeotropic mixed refrigerant to supply cold air to the interior space, wherein an inlet of the hotline is connected to an outlet of the condenser by a pipe having a diameter, one end of the pipe is directly connected to the inlet of the hotline and an other end of the pipe is directly connected to the outlet of the condenser such that a temperature of the non-azeotropic mixed refrigerant flowed into the inlet of the hotline maintains a predetermined value.

2. The refrigerating apparatus according to claim 1, further comprising an edge condenser between the hotline and the expander to further radiate the heat of the non-azeotropic mixed refrigerant.

3. The refrigerating apparatus according to claim 2, wherein the hotline is disposed at a front insulating wall of the main body, and the edge condenser is disposed at a rear insulating wall of the main body.

4. The refrigerating apparatus according to claim 1, further comprising an edge condenser in parallel with the hotline between the hotline and the expander.

5. The refrigerating apparatus according to claim 4, further comprising:

a branch to branch the non-azeotropic mixed refrigerant into the hotline and the edge condenser;

a joint to join the non-azeotropic mixed refrigerant discharged from the hotline and the edge condenser; and a valve between the branch and the joint to control an amount of the non-azeotropic mixed refrigerant that flows to the hotline.

6. The refrigerating apparatus according to claim 1, wherein the at least one evaporator comprises:

a first evaporator to provide cold air to a freezer compartment; and a second evaporator to provide cold air to the refrigerating compartment.

7. The refrigerating apparatus according to claim 1, wherein the at least one evaporator comprises:

a first evaporator to evaporate the expanded non-azeotropic mixed refrigerant; and a second evaporator spaced apart from the first evaporator and to further evaporate the non-azeotropic mixed refrigerant discharged from the first evaporator.

8. The refrigerating apparatus according to claim 1, wherein the inlet of the hotline is connected to the outlet of the condenser, without intervening a gas-liquid separator.

9. The refrigerating apparatus according to claim 1, wherein the compressor is controlled to perform a continuous operation mode of continuously operating without stopping during operation of the refrigerating apparatus.

10. The refrigerating apparatus according to claim 1, wherein the compressor is controlled to perform a continuous operation mode and an intermittent mode, the intermittent mode being operated with a first frequency and a stroke of a first capacity and the compressor being intermittently operated during the intermittent mode, and the continuous operation mode being operated with a second frequency lower than the first frequency and a stroke of a second capacity lower than the stroke of the first capacity and the compressor being continuously operated during the continuous operation mode.

11. The refrigerating apparatus according to claim 1, further comprising a regenerative heat exchanger to exchange heat between the non-azeotropic mixed refrigerant discharged from the evaporator and the non-azeotropic mixed refrigerant flowing through the expander, wherein the regenerative heat exchanger comprising a heat exchanging region exchanging heat between the non-azeotropic mixed refrigerant discharged from the evaporator and the non-azeotropic mixed refrigerant flowing through the expander, wherein the regenerative heat exchanger comprising a shielding region shielding heat exchange between the non-azeotropic mixed refrigerant discharged from the evaporator and the non-azeotropic mixed refrigerant flowing through the expander.

12. The refrigerating apparatus according to claim 1, wherein the non-azeotropic mixed refrigerant consists of isobutane and propane, and wherein the isobutane has a weight ratio of 50%≤isobutane≤90%.

13. He refrigerating apparatus according to claim 1, wherein a gliding temperature difference of the non-azeotropic mixed refrigerant is greater than 4° C.

14. A controlling method for a refrigerating apparatus, the refrigerating apparatus comprising:

a main body having an interior space;

a door to open and close an opening of the main body;

a compressor to compress a non-azeotropic mixed refrigerant;

a condenser to condense the compressed non-azeotropic mixed refrigerant;

a hotline disposed at a contact portion between the main body and the door to flow the non-azeotropic mixed refrigerant having passed through the condenser, wherein heat of the non-azeotropic mixed refrigerant is radiated by the hotline;

an expander to expand the non-azeotropic mixed refrigerant from the hotline; and at least one evaporator to evaporate the expanded non-azeotropic mixed refrigerant to supply cold air to the interior space, wherein at least one of a frequency or a stroke of the compressor is controlled, such that the compressor performs a continuous operation mode in which the compressor continuously operates without stopping during operation of the refrigerating apparatus such that a temperature of the non-azeotropic mixed refrigerant discharged from the condenser maintains a predetermined value, and in the continuous operation mode, the non-azeotropic mixed refrigerant continues to flow such that the heat of the non-azeotropic mixed refrigerant is radiated by the hotline.

15. The controlling method for a refrigerating apparatus according to claim 14, the refrigerating apparatus further comprising an edge condenser between the condenser and the expander.

16. The controlling method for a refrigerating apparatus according to claim 14, the refrigerating apparatus further comprising:

an edge condenser in parallel with the hotline and to radiate heat;

a branch to branch the non-azeotropic mixed refrigerant into the hotline and the edge condenser;

a joint to join the non-azeotropic mixed refrigerant discharged from the hotline and the edge condenser; and a valve between the branch and the joint.

17. The controlling method for a refrigerating apparatus of claim 14, wherein the at least one evaporator includes a freezer compartment evaporator that supplies cold air to a freezer compartment, and is connected in series with a refrigerating compartment evaporator that supplies cold air to a refrigerating compartment.

18. A refrigerating apparatus, comprising:

a main body having an interior space;

a door to open and close an opening of the main body;

a compressor to compress a non-azeotropic mixed refrigerant;

a condenser to condense the compressed non-azeotropic mixed refrigerant;

a hotline disposed at a contact portion between the main body and the door to flow the non-azeotropic mixed refrigerant passing through the condenser, wherein heat of the non-azeotropic mixed refrigerant is radiated by the hotline;

an expander to expand the non-azeotropic mixed refrigerant from the hotline;

at least one evaporator to evaporate the expanded non-azeotropic mixed refrigerant to supply cold air;

an edge condenser between the condenser and the expander and in parallel with the hotline to radiate the heat of the non-azeotropic mixed refrigerant; and a valve to control an amount of the non-azeotropic mixed refrigerant flowing into the edge condenser and an amount of the non-azeotropic mixed refrigerant flowing into the hotline relative to the amount of the non-azeotropic mixed refrigerant flowing into the edge condenser.

19. The refrigerating apparatus according to claim 18, wherein the compressor is controlled to perform a continuous operation mode of continuously operating without stopping during operation of the refrigerating apparatus.

20. The refrigerating system of claim 18, wherein the at least one evaporator includes a freezer compartment evaporator that supplies cold air to a freezer compartment, and is connected in series with a refrigerating compartment evaporator that supplies cold air to a refrigerating compartment.

* * * * *